US011959272B1

(12) United States Patent
deNourie

(10) Patent No.: US 11,959,272 B1
(45) Date of Patent: Apr. 16, 2024

(54) BUILDING CONSTRUCTION

(71) Applicant: Herbert L. deNourie, Omaha, NE (US)

(72) Inventor: Herbert L. deNourie, Omaha, NE (US)

( * ) Notice: Subject to any disclaimer, the term of this patent is extended or adjusted under 35 U.S.C. 154(b) by 0 days.

(21) Appl. No.: 17/532,975

(22) Filed: Nov. 22, 2021

Related U.S. Application Data

(60) Provisional application No. 63/118,294, filed on Nov. 25, 2020.

(51) Int. Cl.
*E04B 1/80* (2006.01)
*E04B 1/76* (2006.01)

(52) U.S. Cl.
CPC ..... *E04B 1/806* (2013.01); *E04B 1/7662* (2013.01); *E04B 2001/7691* (2013.01)

(58) Field of Classification Search
CPC .. E04B 2001/7691; E04B 1/7675; E04B 1/78; E04B 1/74; E04B 1/76; E04B 1/7608; E04B 1/7612; E04B 1/762; E04B 1/7662; E04B 1/806; E04B 1/62; E04B 1/64; E04B 1/7069; E04B 1/7076
See application file for complete search history.

(56) References Cited

U.S. PATENT DOCUMENTS

| | | | |
|---|---|---|---|
| 246,626 | A | 9/1881 | Morse |
| 1,522,708 | A | 1/1925 | Andrews |
| 1,651,539 | A | 12/1927 | Olson |
| 1,757,479 | A | 5/1930 | Ernst et al. |
| 1,800,150 | A | 4/1931 | Leslie et al. |

(Continued)

FOREIGN PATENT DOCUMENTS

| | | | |
|---|---|---|---|
| CN | 103711208 | A | 4/2014 |
| EP | 0919673 | A2 | 6/1999 |

(Continued)

OTHER PUBLICATIONS

Schad, L.W., et al., "Insulating Effect of Successive Air Spaces Bounded By Bright Metallic Surfaces", 37th Annual Meeting of the American Society of Heating and Ventilating Engineers, Paper No. 894, 1931, 16 Pages.

(Continued)

*Primary Examiner* — Jessica L Laux
(74) *Attorney, Agent, or Firm* — Patent GC LLC; Peter Gordon

(57) ABSTRACT

Instead of focusing solely on material insulation as a solution for energy efficiency, a wall construction, or other opaque structure of a building, can include a sequence of highly reflective insulation elements that block heat energy exchange across air spaces, combined with material insulation supporting a heat energy highly reflective surface of the highly reflective insulation element. A highly reflective insulation element is formed by enclosing an air space between surfaces, of which one or both of those surfaces is a heat energy highly reflective surface. The heat energy highly reflective surface can be provided by a layer applied to a material. In an opaque building structure, two or more such highly reflective insulation elements, using three or more heat energy highly reflective surfaces, and two or more air spaces, where the material supporting at least one of the heat energy highly reflective surfaces is a material insulator, can improve energy efficiency.

14 Claims, 10 Drawing Sheets

(56) References Cited

U.S. PATENT DOCUMENTS

| | | | | |
|---|---|---|---|---|
| 1,890,418 | A | 12/1932 | Krnst | |
| 1,906,510 | A | 5/1933 | Baluf et al. | |
| 1,934,174 | A | 11/1933 | Eduard | |
| 1,954,582 | A | 4/1934 | Aschenbrener | |
| 1,963,609 | A | 6/1934 | Balduf et al. | |
| 2,015,817 | A | 10/1935 | Ernst | |
| 2,054,694 | A | 9/1936 | Eldredge | |
| 2,101,836 | A | 12/1937 | Benedict | |
| 2,172,048 | A | 9/1939 | Johnson | |
| 2,189,409 | A | 2/1940 | Sibley | |
| 2,235,681 | A | 3/1941 | Haven et al. | |
| 2,251,585 | A | 8/1941 | Finck | |
| 2,312,301 | A | 3/1943 | Channing et al. | |
| 2,312,987 | A | 3/1943 | Grassick | |
| 2,332,287 | A | 10/1943 | Philip | |
| 2,488,548 | A | 11/1949 | Maccracken | |
| 2,502,575 | A | 4/1950 | Raphael | |
| 2,559,869 | A | 7/1951 | Gay | |
| 2,569,234 | A | 9/1951 | Finck | |
| 2,595,905 | A | 5/1952 | Maria | |
| 2,643,000 | A | 6/1953 | Morrison | |
| 2,643,022 | A | 6/1953 | Cornell | |
| 2,750,313 | A | 6/1956 | Alexander et al. | |
| 2,777,786 | A | 1/1957 | Alexander et al. | |
| 3,001,473 | A | 9/1961 | Shepheard | |
| 3,007,596 | A | 11/1961 | Matsch | |
| 3,018,016 | A | 1/1962 | Huilicka | |
| 3,027,608 | A | 4/1962 | Ryan | |
| 3,043,112 | A | 7/1962 | Head | |
| 3,069,301 | A | 12/1962 | Buckley et al. | |
| 3,192,575 | A | 7/1965 | Rosenau et al. | |
| 3,239,144 | A | 3/1966 | Holger | |
| 3,641,724 | A | 2/1972 | Palmer | |
| 3,769,770 | A | 11/1973 | Deschamps et al. | |
| 3,832,992 | A | 9/1974 | Trombe et al. | |
| 3,948,295 | A | 4/1976 | Lemont et al. | |
| 4,004,389 | A | 1/1977 | Difazio | |
| 4,051,891 | A | 10/1977 | Harrison | |
| 4,074,482 | A | 2/1978 | Klahr | |
| 4,108,373 | A | 8/1978 | Chiapale et al. | |
| 4,143,197 | A | 3/1979 | Jasionowicz et al. | |
| 4,143,815 | A | 3/1979 | Meysenburg | |
| 4,161,087 | A | 7/1979 | Levesque | |
| 4,271,826 | A | 6/1981 | Duchene | |
| 4,286,576 | A | 9/1981 | McClelland | |
| 4,335,166 | A | 6/1982 | Lizardo et al. | |
| 4,337,990 | A | 7/1982 | Fan et al. | |
| 4,368,226 | A | 1/1983 | Mucaria | |
| 4,459,789 | A | 7/1984 | Ford | |
| 4,462,883 | A | 7/1984 | Hart | |
| 4,478,018 | A | 10/1984 | Holand | |
| 4,479,018 | A | 10/1984 | Van | |
| 4,510,726 | A | 4/1985 | MacDonald | |
| 4,532,917 | A | 8/1985 | Taff et al. | |
| 4,550,046 | A | 10/1985 | Miller | |
| 4,663,908 | A | 5/1987 | Kestel | |
| 4,674,253 | A | 6/1987 | Young | |
| 4,780,164 | A | 10/1988 | Rueckheim et al. | |
| 4,782,889 | A | 11/1988 | Bourne | |
| 4,799,745 | A | 1/1989 | Meyer et al. | |
| 4,815,245 | A | 3/1989 | Gartner | |
| 4,824,710 | A | 4/1989 | Dieul | |
| 4,943,484 | A | 7/1990 | Goodman | |
| 4,974,382 | A | 12/1990 | Avellanet | |
| 5,038,693 | A | 8/1991 | Kourtides et al. | |
| H975 | H | 11/1991 | Selkowitz et al. | |
| 5,230,941 | A * | 7/1993 | Hollander | B65D 81/3853 428/116 |
| 5,277,959 | A | 1/1994 | Kourtides et al. | |
| 5,316,835 | A | 5/1994 | Groft et al. | |
| 5,344,718 | A | 9/1994 | Hartig et al. | |
| 5,413,864 | A | 5/1995 | Miyazaki et al. | |
| 5,454,428 | A | 10/1995 | Pickard et al. | |
| 5,514,476 | A | 5/1996 | Hartig et al. | |
| 5,557,462 | A | 9/1996 | Hartig et al. | |
| 5,570,555 | A | 11/1996 | Ferguson et al. | |
| 5,765,330 | A | 6/1998 | Richard | |
| 5,772,716 | A | 6/1998 | Krohm et al. | |
| 5,862,854 | A | 1/1999 | Gary | |
| 6,308,491 | B1 | 10/2001 | Porter | |
| 6,797,356 | B2 | 9/2004 | Zupon et al. | |
| 7,089,995 | B2 | 8/2006 | Koscheyev et al. | |
| 7,571,578 | B2 | 8/2009 | Moody et al. | |
| 7,735,282 | B2 * | 6/2010 | Price | E04B 7/225 52/407.5 |
| 8,082,916 | B2 | 12/2011 | Colson | |
| 8,256,690 | B2 | 9/2012 | Newberry | |
| 8,276,337 | B2 | 10/2012 | Plini | |
| 8,635,824 | B2 | 1/2014 | Scherrer | |
| 8,806,824 | B2 | 8/2014 | Schwan | |
| 9,103,113 | B2 | 8/2015 | Lockhart | |
| 9,140,064 | B2 | 9/2015 | Guthrie | |
| 9,163,397 | B2 | 10/2015 | Willson et al. | |
| 9,469,984 | B2 | 10/2016 | Miks et al. | |
| 9,783,980 | B2 | 10/2017 | Snyder et al. | |
| 9,783,985 | B2 | 10/2017 | Iverson | |
| 9,957,715 | B1 * | 5/2018 | Carlson | E04C 2/296 |
| 10,024,551 | B2 | 7/2018 | Lin | |
| 10,626,608 | B2 | 4/2020 | Lambach et al. | |
| 10,731,332 | B1 | 8/2020 | Iverson | |
| 10,773,882 | B2 | 9/2020 | Scherrer et al. | |
| 2003/0061777 | A1 | 4/2003 | Alderman | |
| 2004/0000112 | A1 | 1/2004 | Alderman | |
| 2004/0000113 | A1 * | 1/2004 | Alderman | E04B 1/767 52/404.1 |
| 2004/0250490 | A1 | 12/2004 | Hall | |
| 2005/0055982 | A1 | 3/2005 | Medina | |
| 2010/0236172 | A1 | 9/2010 | Wirth | |
| 2011/0146171 | A1 | 6/2011 | Flatland | |
| 2011/0239573 | A1 | 10/2011 | Lockhart | |
| 2014/0115991 | A1 * | 5/2014 | Sievers | E04C 2/386 52/309.4 |
| 2017/0138040 | A1 * | 5/2017 | Groft | E04B 1/80 |
| 2017/0174952 | A1 | 6/2017 | Bess et al. | |
| 2017/0247883 | A1 | 8/2017 | Iverson | |
| 2018/0066427 | A1 | 3/2018 | Snyder | |
| 2020/0190806 | A1 | 6/2020 | Johnson et al. | |
| 2020/0407972 | A1 | 12/2020 | Snyder et al. | |
| 2021/0372120 | A9 | 12/2021 | Bess et al. | |

FOREIGN PATENT DOCUMENTS

| | | | | |
|---|---|---|---|---|
| EP | 1582649 | B2 | 8/2010 | |
| EP | 1783289 | A3 | 1/2011 | |
| EP | 2314787 | B1 | 6/2012 | |
| EP | 1939374 | B1 | 6/2013 | |
| EP | 2366845 | B1 | 6/2013 | |
| FR | 2861365 | A1 | 4/2005 | |
| FR | 2893134 | A1 | 5/2007 | |
| FR | 2982523 | B1 | 1/2014 | |
| GB | 1064812 | A | 4/1967 | |
| GB | 2134444 | A | 8/1984 | |
| GB | 2398758 | B | 4/2006 | |
| GB | 2451183 | A * | 1/2009 | E04B 1/4178 |
| GB | 2496739 | B | 4/2014 | |
| WO | WO-2007143782 | A1 * | 12/2007 | E04B 1/78 |

OTHER PUBLICATIONS

Robinson, H.E., et al., "The Thermal Insulating Value of Air Spaces", U.S. Dept. of Commerce, Nation Bureau of Standards Report No. 3030, Jan. 11, 1954, 68 pages.

Robinson, H.E., et al., "Thermal Resistance of Airspaces and Fibrous Insulations Bounded by Reflective Surfaces", U. S. Dept. of Commerce, National Bureau of Standards, Building Materials and Structures Report 151, Nov. 14, 1957, 28 pages.

Alpen High Performance Products (corporate author), "Alpen Zenith Series" product brochure, dated 2022, 12 Pages.

Johns Manville (corporate author), "AP™ Foil-Faced Polyisocyanurate Foam Sheathing" product brochure, dated Mar. 2022, 4 Pages.

Stiburek, Joseph, "BSI-096: Hot And Wet but Dry", Building Science Corporation, Jun. 13, 2016, 7 Pages.

(56) References Cited

OTHER PUBLICATIONS

National Research Council Canada, Division of Building Research, ASHRAE 1981 Fundamentals Handbook, Chapter 23, "Design Heat Transmission Coefficients", DBR Paper No. 1235, 1981, 33 Pages.
U.S. Dept. of Defense, "Design Procedures For Passive Solar Buildings", Military Handbook, MIL-HDBK-1003/19, May 3, 1987, 17 Pages.
Eastman Chemical Company (corporate author), Heat Mirror IG product brochure, dated 2023, 3 Pages.
Anonymous, Wikipedia, "Effect of radiation on perceived temperature", retrieved from "https://en.wikipedia.org/w/index. php? title= Effect_of radiation_on_perceived_temperature&oldid=1022296110", last edited date: May 9, 2021, 2 Pages.
U.S. Department of Energy, "Energy Efficiency & Renewable Energy", DOE/GO-102015-4569, pp. 102 and 103, Apr. 2015, 3 Pages.
Applied Building Technology Group, LLC (corporate author), "Evaluation of Reflective and Non-Reflective Airspaces for Energy Code and FTC R-value Rule Compliance", ABTG Research Report No. 1601-02, Jan. 14, 2021, 19 Pages.
Owens Corning (corporate author), "Foamular@ High-R CW Plus Extruded Polystyrene (XPS) Rigid Foam Insulation" product data sheet, Pub, No. 57176-M, Feb. 2015, 4 Pages.
Lyons, Peter, et al., "Glazing", from Yourhome.gov.au, dated 2020, 22 Pages.
Anonymous, "The Physics of Foil," from https://osb.westfraser.com/wp-content/uploads/2017/05/The-Physics-of-Foil. pdf, 6 Pages, Oct. 14, 2010.
Alpen High Performance Products (corporate author), "Heat Mirror IG" product brochure, 2016, 7 Pages.
Low-E UK, Ltd (corporate author), "How Does Reflective Foil Insulation Work?", Apr. 25, 2018, 13 Pages.
Anonymous, "Thermal Performance of Windows, Doors and Shading Devices—Detailed Calculations", Iso Tc 163, ISO/DIS 15099, Jan. 12, 2000, 72 pages.
Mosher, Max, et al., "Insulation", from Yourhome.gov.au, dated 2020, 29 Pages.
Banionis, F et al. "Determination of thermal resistance of reflective insulation product according Lst En 16012:2012 +A1:2015 and LST EN ISO 8990:1999", Test Report No. 141-1-1 SF/17 U, from Kaunas University of Technology, Laboratory of Building Physics, Sep. 8, 2017, 5 Pages.
U.S. Dept. of Commerce, National Bureau of Standards, "Technical Information on Building Materials for use in the Design of Low Cost Housing", TIBM-16, May 22, 1936. 8 Pages.
General Services Administation, "LightWeight Quad-Pane Windows", GPG-048, Nov. 2021, 4 Pages.
Yale University, "Energy History: MIT Solar House I, 1939", web page dated 2023, 4 Pages.
Engineering ToolBox (corporate author), "Moist Air—Density vs. Water Content and Temperature." Available online at: https://www.engineeringtoolbox.com/density-air-d_680.html [Accessed Feb. 22, 2023].
Reardon, Chris, "Passive Cooling", Yourhome.gov.au, dated 2020, 21 Pages.
Vitro (corporate author), "Passive Low-E Glass For Cooler Climates", from http://www.vitrowindowglass.com/ window_glass/passive_lowe.aspx, dated 2001-2022, accessed Feb. 23, 2023, 2 Pages.
Georgia-Pacific Gypsum LLC (corporate author), "Prescriptive R-Values", Feb. 2012, 2 Pages.
Fabian, Eileen, "Psychrometric Chart Use", Jul. 12, 2016, 7 Pages, from https://extension.psu.edu/psychrometric-chart-use.
Silvercote LLC (corporate author), "Solar Guard Reflective Insulation" product brochure, 2019, 2 Pages.
Dow Chemical Company (corporate author), "Tech Solutions 513.0: Thermax Wall System", Form No. 179-04503X-1210MCK, Oct. 2009, 28 Pages.
DrJ Engineering LLC (corporate author), "Thermo-Ply® Blue & Thermo-Ply@ Blue AMG Structural Sheathing", Technical Evaluation Report (TER) No. 1004-02, Mar. 29, 2016, 16 Pages.
Portland Cement Association (corporate author), "The Real Value of Resilient Construction", May 2019, 26 Pages.
National Research Council Canada, Division of Building Research, 2005 Ashrae Handbook-Fundamentals(SI), Chapter 23: "Thermal And Moisture Control In Insulated Assemblies-Fundamentals", 2005, 22 Pages.
Thermophysical Properties Research Laboratory, Inc., (corporate author), "Thermal Gravimetric Analysis & Simultaneous Thermal Analysis", dated Jan. 5, 2012, 1 Page.
British Standards Institution, "Thermal insulation for buildings—Reflective insulation products—Determination of hte declared thermal performance", BSI Standards Publication Bs En 16012:2012+A1:2015, Feb. 2015, 36 Pages.
Reardon, Chris, et al., "Thermal Mass", Yourhome.gov.au, dated 2020, 16 Pages.
Building Science Corporation (corporate author), "Thermal Metric Summary Report", Jun. 18, 2015, pp. 108-116, 10 Pages.
Alpen High Performance Products (corporate author), "Triple- & Quad-Pane Thin Glass", circa 2020, 2 Pages.
RIMA International, "Understanding And Using Reflective Insulation, Radiant Barriers And Radiation Control Coatings", Third Edition, Jun. 2014, 27 Pages.
Fullam, Kiara, "Vented vs Unvented Roofs: What is the Best Design?", Jun. 2, 2020, 8 Pages, available at: https:// mechanical-hub.com/vented-vs-unvented-roofs-what-is-the-best-design/.
Bridge, Simon et al., "Why do Transparent Objects Let Light Pass Through But Opaque Objects don't?", from www. quora.com, 27 Pages.
Ayesha, "How Does Aluminum Foil Absorb or Reflect Heat?", All Things Aluminum, Sep. 9, 2021, 6 Pages.
Bahrami, Majid, "Radiation Heat Transfer", Chapter 12, E&CE 309, Spring, 2005, 20 Pages.
Bonilauri, Enrico, "Insulation Materials: Discovering The Lambda Value", from emu.systems, Feb. 29, 2016, 9 Pages.
Burns, P.J., "Thickness Effect in Low-Density Insulation", NBSIR 84-2906, Aug. 1984.
Chao, Julie, "Super window' Could Save $10 Billion Annually in Energy Costs", from News from Berkeley Lab, Jun. 6, 2018, 5 Pages.
Courville, G.E., et al., "Comparision of the Dynamic Thermal Performance of the Insulated Roof Systems", ORNL Report No. CONF-890854-1 and DE89006628, Jan. 1989. https://www.osti.gov/servlets/purl/6297318. 25 pages.
Crowe, Joan, "Proper design of vapor retarders requires close attention to temperature", NRCA Roofing, Feb. 2005, 9 Pages.
Desjarlais, "The Thermal Performance of Reflective Insulation Materials And Systems With Horizontal Heat Flow: A parametric Study", ORNL Building IV Proceedings, 1989, pp. 271-285, 15 Pages. available at https://web.ornl.gov/sci/ buildings/conf-archive/1989%20B4%20papers/024.pdf.
Fairey, Philip, "Radiant Energy Transfer and Radiant Barrier Systems in Buildings", Florida Solar Energy Center, University of Central Florida, Publication No. FSEC-DN-6-86, 1986, 6 Pages.
Fine, H.A., et al., "Analysis of Heat Transfer in Building Thermal Insulation", OAK Ridge National Laboratory (Ornl)), ORNL/TM-7481, 1980, 78 Pages.
Graham, Mark, "Understanding R-value", NRCA Roofing, Feb. 2022, 5 Pages.
Garden, G.K., "Thermal Considerations in Roof Design", Canadian Building Digests, CBD-70. From National Research Council Canada, Oct. 1965, 6 Pages.
Hedges, Scott, et al., "Innovation in Residential Construction Systems in Sweden", Proc. 1st Residential and Building Design and Construction Conference. Pennsylvania Housing Research Center, 2013. 10 Pages.
Holladay, Martin, "A Superinsulated House from 1984," Oct. 14, 2016, 2 Pages. From https://www. greenbuildingadvisor.com/article/a-superinsulated-house-from-1984.
Actis (corporate author), "Actis Hybrid Solutions and Systems", product brochure, dated Oct. 2019. 20 pages.

(56) References Cited

OTHER PUBLICATIONS

Hybris, "An Innovative Reflective Insulation", For Roofs, Walls And Ceilings, Retrieved on Feb. 22, 2023, 6 Pages.
Johnson, Timothy, et al., "M.I.T. Solar Building 5: The Second Year's Performance", Dept. of Energy report Doe/ CS/34513-1, Nov. 1979, 101 Pages.
Kenisarin, M.M., "Short-Term Storage of Solar Energy. 1. Low Temperature Phase-Change Materials", Applied Solar Energy (Geliotekhnika), vol. 29, No. 2, pp. 48-65, 1993, 18 Pages.
Kralj, Ales, et al., "Investigations of 6-Pane Glazing: Properties And Possibilities", Energy & Buildings, vol. 190, pp. 61-68, Feb. 25, 2019, 8 Pages.
Kreider, Jan F., et al., "Solar Heating and Cooling: Engineering, Practical Design, and Economics", Revised First Edition, Hemisphere Publishing Corporation, 1975, pp. 20-24, 4 Pages.
Kusuda, Tamami, "Fundamentals of Building Heat Transfer", Journal of Research of the National Bureau of Standards, vol. 82, No. 2, pp. 97-106, Sep.-Oct. 1977, 10 Pages.
Levins, W.P., et al., "Cooling Energy Measurements of Single-Family Houses With Attics Containing Radiant Barriers In Combination With R-11 And R-30 Ceiling Insulation", Oak Ridge National Laboratory, ORNL/CON-226, May 1987, 84 Pages.
Levins, W.P., et al., "Heating Energy Measurements of Single-Family Houses With Attics Containing Radiant Barriers In Combination With R-11 and R-30 Ceiling Insulation", Oak Ridge National Laboratory, ORNL/CON-239, Aug. 1988, 129 Pages.
Lstiburek, Joseph, "A Crash Course in roof Venting", in Fine Homebuilding, pp. 68-72, Aug./Sep. 2011, 5 Pages.
Lstiburek, Joseph, "BSI-001: The Perfect Wall", Building Science Corporation, Jul. 15, 2010, 4 Pages.
Lstiburek, Joseph, "BSI-028: Energy Flow Across Enclosures", Building Science Corporation, Dec. 1, 2009, 7 Pages.
Lstiburek, Joseph, "BSI-070: First Deal With The Manure And Then Don't Suck", Building Science Corporation, Jun. 11, 2014, 7 Pages.
Lstiburek, Joseph, "BSI-075: How Do Buildings Stack Ip?", Building Science Corporation, Feb. 14, 2014, 9 Pages.
Lstiburek, Joseph, "BSI-136: Piltdown Man Does Thermal Resistance*", Building Science Corporation, Oct. 15, 2022, 10 Pages.
Maines, Michael, "Thermal- and Moisture-Control Layers for an Energy- Efficient House", from: https://www. finehomebuilding.com/project-guides/insulation/prohome-wall-thermal-moisture-control-layers, 15 Pages. date unknown.
Pettit, Betsy, "RR-1401: Design Challenges of the NIST Net Zero Energy Residential Test Facility", Building Science Corporation, Research Reports, Sep. 18, 2014, 13 Pages.
Hubble, Andrew, "A Complete Breakdown of Exterior Wall Sheathing Options", Jun. 4, 2018, 5 Pages, from https://barricadebp.com/news/exterior-wall-sheathing.
Rowley, Frank, et al., "Thermal Conductivity of Building Materials", University of Minnesota, Engineering Experiment Station, Bulletin No. 12, 1937, 143 Pages.
Yarbrough, D.W., "Assessment of Reflective Insulations for Residential and Commercial Applications", Oak Ridge National Laboratory, ORNL/TM-8891, Oct. 1983, 74 Pages.
Examples Lab, Inc. (corporate author), "20 Examples of Translucent, Opaque and Transparent", from https://www. exampleslab.com/20-examples-of-translucent-opaque-and-transparent/, 2023, 5 Pages.
Selkowitz, Stephen, et al., "Breaking The 20 Year Logjam to Better Insulating Windows", Lawrence Berkeley National Laboratory, Report 10.20357/B76K5K, Sep. 2018, 23 Pages.
Sherburne, Morgan, "The House of the Day After Tomorrow," MIT Technology Review, Jun. 22, 2010, 3 Pages.
Sherwood, Gerald, et al., "Energy Efficiency In Light-Frame Wood Construction", U.S. Dept. Agriculture, Forest Service, Forest Products Laboratory, Research Paper FPL 317, 1979, 61 Pages.
Wilkes, Gordon, "Reflective Insulation," Industrial and Engineering Chemistry, vol. 31, No. 7, pp. 832-838, 1939, 7 Pages.
Denzer, Anthony, "Energy Efficiency and the Swedish Catalog House", ASHRAE 2020 virtual conference, Paper Session 18, 2020, 32 pages.
Paper Thermometer Company (corporate author), "A Note an Ambient Temperature and Surface Temperature", Apr. 2021, 1 Page.
La Vardera, Gregory, "USA new Wall—Swedish Platform Framing in Detail", Jul. 18, 2011, 8 pages. from: http://blog. amidesign.com/2011/06/.
Vitro Architectural Glass, "Optimal Low-E Coating Placment for Double- and Triple-Glazed IGUs", from: https://glassed. Vitroglazings.com/topics/optimal-low-e-coating-placement-for-double-and-triple-glazed-igus, undated, 2 pages.
Lstiburek, J., "Forty Years of Air Barriers", Building Sciences Corporation Insight BSI-084, 2015.
Lstiburek, J., "Macbeth Does Vapor Barriers", Building Sciences Corporation Insight BSI-073, 2013.
Lstiburek, J., "Mind the Gap, Eh!", Building Sciences Corporation Insight BSI-038, 2013.
Lstiburek, J., "Joni Mitchell, Water and Walls", Building Sciences Corporation Insight BSI-071, 2013.
Ionescu, Constantin, et al., "The historical evolution of the energy efficient buildings", in Renewable and Sustainable Energy Reviews, vol. 49 (2015), pp. 243-253.
Latha, P.K., et al., "Role of building material in thermal comfort in tropical climates—A review", in Journal of Building Engineering, vol. 3 (2015), pp. 104-113.
Saber, H., "Thermal Resistance of Enclosed Reflective Airspaces in Building Applications", in Proceedings of the Building Enclosure Science and Technology Conference (BEST4), 2015.
Saber, H., et al., "Determining the Thermal Resistance of Enclosed Reflective Airspace", in Buildings, 13, 662, 2023.
Lemieux, Daniel, et al., "Wall Systems", in Whole Building Design Guide, (2016). (available at: https://wbdg.org/guides-specifications/building-envelope-design-guide/wall-systems).
Kesik, Ted, "Moisture Management Strategies", in Whole Building Design Guide, (2016). (available at: https://wbdg.org/resources/moisture-management-strategies).
Yarbrough, David, et al., "Hybrid and Reflective Insulation Assemblies for Buildings", in Journal of Power and Energy Engineering, 2016, 4, pp. 23-31.
Gawande, Anup, et al., "Thermal Energy Storage by Phase Change Material", in International Research Journal of Engineering and Technology, vol. 3, Issue 10, Oct. 2016, pp. 149-152.
Saber, Hamed, et al., "Thermal analysis of above-grade wall assembly with low emissivity materials and furred airspace", in Building and Environment 46, pp. 1403-1414 (2011).
Overbey, Daniel, "Defining mass walls through heat capacity", Building Enclosure emagazine, Feb. 12, 2016 (see https://www.buildingenclosureonline.com/articles/print/85698-defining-mass-walls-through-heat-capacity).
Ordache, Vlad, et al., "Permeability measurements of apssive house during two construction stages", in Energy Procedia 85 (2016), pp. 279-287.
Stiburek, J., "Vitruvius Does Veneers", Building Sciences Corporation Insight BSI-086, 2015.
Albatayneh, Aiman, et al., "The Significance of Building Design for the Climate", Environmental and Climate Technologies, vol. 22, pp. 165-178 (2018).
Lacasse, Michael, "Field Evaluation of Thermal and Moisture Response of Highly-Insulated Wood-frame Walls," presentation at Buildings XIII conference, (2016).
Zhang, Huibo, et al., "Practical moisture buffering effect of three hygroscopic materials in real-world conditions", in Energy and Buildings, 139 (2017), pp. 214-223.
Medina, Mario, "A comprehensive review of Radiant Barrier Research Including Laboratory and Field Experiments", in ASHRAE Transactions, 118 Part 1, 2012.
Feist, Wolfgang, "Energy Efficiency—The Global Contribution of the Passive House Standard", proceedings of SUDee2018 Workshop, (2018).
Feist, Wolfgang, "The Passive House—a solution for affordable housing", Proc. 22nd International Passive House Conference, 2020.

(56) References Cited

OTHER PUBLICATIONS

Anonymous, "Roof Battens, All You Need to Know About Roofing Battens", date unknown, 7 pages.
Curcija, Charlie, et al., "Triple Glazing with Thin Non-Structural Center Glass", webpage of Lawrence Berkeley National Laboratory, Windows and Daylighting, 2019 (available at: https://windows.lbl.gov/triple-glazing-thin-non-structural- center-glass).
Yost, Peter, "Thin Glass to Change High-Performance Window Market", Building Green, vol. 28, Issue 2, Feb. 4, 2019.
Moreno, Belen, et al., "Industrialization of Water Flow Glazing Facades by means of modular units", 7th Eur. Conf., en. Energy Sys. Jun. 10-12, 2019, Madrid, Spain.
Saber, H., "Effective R-value of enclosed reflective space for different building applications", Journal of Building Physics, 43, 398-427 (2020).
Holladay, Martin, "Buyer's Guide to Insulation: Rigid Foam", Fine Homebuilding, Jan. 2012 (available at https://www.finehomebuilding.com/2012/01/24/buyers-guide-to-insulation-rigid-foam).
Stiburek, J., "Zeroing In", Building Sciences Corporation Insight BSI-081, 2014.
Taylor, Thomas, "Designing with Polyiso", in GAF building science blog, Dec. 30, 2020, available at https://www.gaf.com/en-us/blog/designing-with-polyiso-281474980064941.
Woodford, Chris, "Heat-reflecting low-E glass", last updated Apr. 11, 2022, (https://www.explainthatstuff.com/how-low- e-heat-reflective-windows-work.html).
Fi-Foil Company, "High Performance Radiant Insulation Systems", Company Brochure, 2020.
Lstiburek, J., "Understanding Walls", Building Sciences Corporation Insight BSI-120, 2013.
Holladay, Martin, "The Klingenberg Wall", Nov. 29, 2013 from Green Building Advisor (https://www. greenbuildingadvisor.com/article/the-klingenberg-wall).
Trus Joist, "Balloon und Platform Framing Details", 2001.
Wright, Graham, and Katrin Klingenberg, "Climate Specific Passive Building Standards", US DOE, Jul. 2015.
Elmahdy, Hakim, et al., "Assessment of the Energy Rating of Insulated Wall Assemblies—A Step Toward Building Energy Labeling", Proceedings of the Tenth international Conference for Enhanced Building Operations, Kuwait, Oct. 2010, document ESL-IC-Oct. 10, 11 (2010).
Panjehpour, Mohammad, "Structural Insulated Panels: Past, Present, and Future", Journal of Engineering, Project, and Production Management, 2013, 3(1), pp. 2-8.
Zhang, Yuan, et al., "Experimental evaluation of structural insulated panels outfitted with phase change materials", Applied Thermal Engineering, vol. 178, Sep. 2020 (incomplete).
Schwartz, Alexander, "Simplified Physics of Vapor and Thermal Insulation", Fourth Revised Edition, Summer 1950.
Schwartz, Alexander, "Heat Flow by Radiation in Buildings," circa 1957.
USDA Forest Service, "Thermal Insulation from Wood for Buildings: Effects of Moisture and its Control," Research Paper, FPL 86, Jul. 1968.
Robinson, H.E., and R.J. Powlitch, "Thermal Conductances of Six Infra Insulations in closed air spaces for various directions of heat flow", National Bureau of Standards Report 3980, Mar. 14, 1955.
Fiorato, A.E., "Laboratory Tests of Thermal Performance of Exterior Walls", Construction Technology Laboratories (CTL), Portland Cement Association, 1979, pp. 221-236.
Hutcheon, N.B., "Fundamental Considerations in the Design of Exterior Walls for Buildings", Technical Report No. 13, National Research Council of Canada, NRC No. 3057, also in Proc. of 67th Annual General and Professional Meeting of the Engineering Institute of Canada, p. 25, May 1, 1953.
Cumali, Z., Sezgen, A., Sullivan, R., and Kammerud, R., "Extension of Methods Used in Analyzing Building Thermal Loads", in Proc. of the ASHRAE/DOE-ORNL conference on Thermal Performance of the Exterior Envelopes of Buildings, Dec. 1979, pp. 411-420.
Scheuneman, E.C. "Estimating Temperature Gradients and Dew Point Temperatures for Building Envelopes." Building Practice Note, No. 26.Division of Building Research, National R~S~TC~ Council of Canada, Mar. 1982.
T.W. Petrie, G.E. Courville, p. H. Shipp, and p. W. Childs, "Measured R-Values for Two Horizontal Reflective Cavities in Series", in Proc. of the ASHRAE/DOE-ORNL conference on Thermal Performance of the Exterior Envelopes of Buildings (Buildings IV), Dec. 1989, pp. 250-257.
A.O. Desjarlais and R.P. Tye, "Research and Development Data to Define the Thermal Performance of Reflective Materials Used to Conserve Energy in Building Applications", Technical Report ORNL/SUB/88-SA835/1, Mar. 1990.
Christian, J., Kosny, J, "Thermal Performance and Wall Ratings", 1995, available at: web.omnl.gov/sci/buildings/docs/ Thermal-Performance-and-Wall-Ratings.pdf.
Lstiburek, J., "Built Wrong from the Start", Fine Homebuilding, Apr./May 2004, pp. 52-57.
Kosny, Jan, William Miller, and Abdi Zaltash, "Dynamically Thermally disconnected Building envelopes—A new Paradigm for Walls and roofs in Low-Energy Buildings", Buildings XI, pp. 2-13, ASHRAE, 2010.
"Thermosiphon Solar Air Heater with heat storage", posted by "Richard" in the blog "Renewable Energy for the Poor Man", http://poormanguides.blogspot.com/2009/06/thermosiphon-solar-air-heater-with-heat.html, dated Jun. 19, 2009.
Siegel, Robert, "Net Radiation Method for Enclosure System involving partially transparent walls", NASA Technical hote, Nasa Tn D-7384, Aug. 1973.
Christian, J., Kosny, J., Desjarlais, A., and Childs, P.,"The Whole Wall Thermal Performance Calculator—on the Net", Proc. of the ASHRAE/DOE-ORNL conference on Thermal Performance of the Exterior Envelopes of Buildings (Buildings VII), paper 32, 1998, pp. 287-299.
Vaproshield, "Breaking Old Rules for Air-Barrier Installation". May 2019. available from https:continuingeducation. bnpmedia.com.
Zarr, Robert, "A History of Testing Heat Insulators at the National Institute of Standards and Technology", ASHRAE Transactions 2001, V. 107, Pt. 2. , Jun. 2001.
Zarr, Robert, "The Testing of Thermal Insulators", in A Century of Excellence in Measurements, Standards, and Technology, NIST Special Publication 958, pp. 10-13, Jan. 2001.
Department of Commerce, National Bureau of Standards, "Aluminum Foil Insulation", Letter Circular LC-465, Jun. 4, 1936.
Anonymous, "UNGREEN | Trombe Wall", Hidden Architecture, dated Nov. 10, 2019.
Lea, Keya, "Passive and Active Solar Retrofit on a Traditional Adobe", Feb. 3, 2013, available at: https:// greenpassivesolar.com/2013/02/passive-solar-retrofit-on-adobe/.
Vitro Architectural Glass. "How Low-E Glass Works", from https://glassed.vitroglazings.com/topics/how-low-e-glass-works (undated).
Vitro Architectural Glass. "Design Considerations with Low-E Coated Glass", Glass Technical Document TD-131, 2016.
Pochee, Hareth, et al., "New insight on passive ice making and seasonal storage of the Iranian Yakhchal and their potential for contemporary applications", in proceedings of NCEUB's PLEA 2017 Edinburgh, 2017.
Anonymous, image from "Atmospheric Pressure", in Encyclopedia Brittanica online, undated, from https://kids.britannica.com/students/article/atmospheric-pressure/604037.
Ward, Peter, "Ozone Depletion Explains Global Warming", Current Physical Chemistry, vol. 6, pp. 275-296, 2016.
Rita, "Passive Cooling Techniques", slides and transcript, from https://www.slideserve.com/Rita/passive-cooling-techniques, dated Dec. 2011.
Yanowitz, Mark, "Wrapping an Older House with Rock Wool Insulation", May 14, 2013, from https://www. greenbuildingadvisor.com/article/wrapping-an-older-house-with-rock-wool-insulation.
Zhao, Dongliang, et al. "Radiative sky cooling: Fundamental principles, materials, and applications", Appl. Phys. Rev. 6, 021306 (2019).
Bourdakis, Eleftherios, et al., "Night time cooling by ventilation or night sky radiation combined with in-room radiant cooling panels

(56) References Cited

OTHER PUBLICATIONS including phase change materials", In: Proceedings of the 36th AIVC Conference: Effective ventilation in high performance buildings, Madrid, Spain, 2015.
McKay, Graham, "It's Not Rocket Science #5: Night Sky Radiant Cooling", Mar. 1, 2013, from https://misfitsarchitecture.com/2013/03/01/its-not-rocket-science-5-night-sky-radiant-cooling/.
Parker, D., et al., "NightCool: A Nocturnal Radiation Cooling Concept", Proceedings of ACEEE 2008 Summer Study on Energy Efficiency in Buildings, American Council for an Energy Efficient Economy, Washington, DC, Aug. 2008.
Pennsylvania State University, "Atmospheric Controllers Of Local Nighttime Temperature", dated 1999-2004, from https://www.weather.gov/source/zhu/ZHU_Training_Page/winds/nighttime_influences/Nighttime_Influences.htm.
Mckay, Graham, "It's Not Rocket Science #6: The Stack Effect", Mar. 5, 2013, from https://misfitsarchitecture. com/2013/03/05/its-not-rocket-science-6-the-stack-effect/.
Multiple authors, "Rumford fireplace", from Wikipedia, https://en.wikipedia.org/wiki/Rumford_fireplace, last edited Jul. 7, 2023, accessed Sep. 20, 2023.
Buckley, Jim, "One-Piece Throat System", 2012, from https://www.rumford.com/classicflyerplan.html.
Miller, Elizabeth, "Rumford Fireplaces are Hotter than Ever", Feb. 16, 2014, from https://www.houzz.com/ magazine/rumford-fireplaces-are-hotter-than-ever-stsetivw-vs~23073755.
McKay, Graham, "The Things Architects Do #4: Reuse, Recycle, Reprise", Mar. 7, 2013, from https:// misfitsarchitecture.com/2013/03/07/the-things-architects-do-3-reuse-recycle-reprise/.
Pennsylvania State University, Lee Grenci, and David Babb, "Meteograms: Messages in Time", 2019 from https:// learningweather.psu.edu/node/16.
Yost, Peter. "First Look at Tstuds." Green Building Advisor, Jul. 3, 2019, accessible at https://www.greenbuildingadvisor.com/article/petes-products-tstuds.

* cited by examiner

Legend:
RI1 = First Highly Reflective Insulation Element
RI2 = Second Highly Reflective Insulation Element
RI3 = Third Highly Reflective Insulation Element
(each is a combined airspace and adjacent surfaces, of which at least one surface is a heat energy highly reflective surface, e.g., foil face)

Legend:
RI1 = First Highly Reflective Insulation Element
RI2+3 = Second and Third Highly Reflective Insulation Elements
RI4 = Fourth Highly Reflective Insulation Element
(each is a combined airspace and adjacent surfaces, of which at least one surface is a heat energy highly reflective surface, e.g., foil face)

BUILDING CONSTRUCTION

CROSS-REFERENCE TO RELATED APPLICATIONS

This application is a nonprovisional patent application of, and claims the benefit under 35 USC § 119 to, prior filed U.S. provisional patent application Ser. No. 63/118,294, entitled "Building Construction", filed Nov. 25, 2020, hereby incorporated by reference.

BACKGROUND

Materials and methods for constructing buildings generally take into consideration many factors, such as structure, cost of materials, ease of construction, utilities, and energy efficiency for heating and cooling. For residential construction in North America, wood frames are commonly used in buildings. Walls generally are constructed using a frame of studs, to which a sheathing and siding typically is applied on the exterior, and wallboard or other kind of surface typically is applied on the interior side. Contained air spaces between studs and wall surface materials typically are used for running electrical, telephony, computer networking, and other utilities. To provide better energy efficiency for heating and cooling, the primary solution used in modern wood-framed residential construction is to place material insulation in contained air spaces where needed. In metal-framed construction, continuous material insulation generally is applied outside the sheathing layer. Open air spaces with ventilation also are typical with brick-clad and other types of facades to drain moisture accumulation within a wall or other structure.

SUMMARY

This Summary introduces a selection of concepts in simplified form that are described further below in the Detailed Description. This Summary neither identifies key or essential features, nor limits the scope, of the claimed subject matter.

Instead of focusing solely on material insulation as a solution for energy efficiency, a wall construction, or other opaque structure of a building, can include a sequence of highly reflective insulation elements that block heat energy exchange across air spaces, combined with material insulation supporting a heat energy highly reflective surface of the highly reflective insulation element. A highly reflective insulation element is formed by enclosing an air space between surfaces, of which one or both of those surfaces is a heat energy highly reflective surface. The heat energy highly reflective surface can be provided by a layer applied to a material. In an opaque building structure, two or more such highly reflective insulation elements, using three or more heat energy highly reflective surfaces, and two or more air spaces, where the material supporting at least one of the heat energy highly reflective surfaces is a material insulator, can improve energy efficiency.

For example, a wall construction of a building typically includes a plurality of studs that support exterior and interior walls. A sequence of highly reflective insulation elements including at least one material insulator supporting at least one of its heat energy highly reflective surfaces, is formed in the space between the exterior and interior walls and between a pair of studs. Similar structures can be formed within other kinds of framing for a wall or for other opaque building structures, such as ceiling, floor, roof, attic, crawlspace, or basement, or other opaque building structure that forms part of an enclosed living space.

As another example, a device can be made for insertion into the space between exterior and interior walls, or other opaque building structures, and within the framing supporting those structures. The device, when so installed, forms such a sequence of highly reflective insulation elements including at least one material insulator supporting at least one of its heat energy highly reflective surfaces. As an example, such a device can include a pair of material insulators enclosing an air gap, where the opposing surfaces of each material insulator has a heat energy highly reflective surface. Thus, the air gap enclosed by the material insulators is enclosed within two heat energy highly reflective surface. When the device is inserted within the space within a wall, with air spaces on either side, the result is a sequence of highly reflective insulation elements, including with two material insulators.

Having two or more enclosed air gaps with heat energy highly reflective layers provides a tandem series of heat energy exchanges across air space elements which supports energy efficient heating and cooling of the space enclosed by walls or other opaque structures of such construction. Different constructions can be used depending on the climate, the building construction, and whether living space is heated, cooled, or ambient, as the number of air spaces and heat energy highly reflective surfaces used depends on the direction of heat transfer in different weather seasons.

In one aspect, an apparatus in an opaque building structure includes a tandem series of highly reflective insulation elements, each highly reflective insulation element comprising one or more parallel heat energy highly reflective surfaces enclosing an air gap. A material insulation element supports at least one of the heat energy highly reflective surfaces of at least one of the highly reflective insulation elements.

In one aspect, a device for use in an opaque building structure includes a first material insulation element having a first surface and a second surface opposite the first surface, wherein the first surface is a first heat energy highly reflective surface, and wherein the second surface is a second heat energy highly reflective surface. The device further includes a second material insulation element having a third surface and a fourth surface opposite the third surface, wherein the third surface is a third heat energy highly reflective surface, and wherein the fourth surface is a fourth heat energy highly reflective surface. The first material insulation element and the second material insulation element are connected to form an air gap between the second surface and the third surface, whereby the air gap, the second surface, and the third surface form a highly reflective insulation element.

In one aspect, an opaque building structure includes framing, and an exterior structure attached to the framing, the exterior structure having an exterior inner surface, and an interior structure attached to the framing, the interior structure having an interior inner surface. Between the exterior structure and the interior structure, a tandem series of highly reflective insulation elements are attached to the framing, each highly reflective insulation element comprising one or more parallel heat energy highly reflective surfaces enclosing an air gap, and parallel with the exterior inner surface and the interior inner surface, and a material insulation element supporting at least one of the heat energy highly reflective surfaces of at least one of the highly reflective insulation elements.

In another aspect, an opaque building structure includes framing, a device attached to the framing, an exterior structure attached to the framing, and an interior structure attached to the framing. The device includes a first material insulation element having a first surface and a second surface opposite the first surface. The first surface is a first heat energy highly reflective surface. The second surface is a second heat energy highly reflective surface. The device further includes a second material insulation element having a third surface and a fourth surface opposite the third surface. The third surface is a third heat energy highly reflective surface. The fourth surface is a fourth heat energy highly reflective surface. The first material insulation element and the second material insulation element are connected to form a first air gap between the second surface and the third surface, whereby the first air gap, the second surface, and the third surface form a first highly reflective insulation element. The exterior structure has an exterior inner surface parallel to and facing and forming a second air gap with the first surface of the first material insulation element. The interior structure has an interior inner surface parallel to and facing and forming a third air gap with the fourth surface of the second material insulation element. The exterior inner surface, second air gap, and first surface form a second highly reflective insulation element. The interior inner surface, third air gap, and fourth surface form a third highly reflective insulation element.

In any of the foregoing the material insulation element can have a first surface supporting the at least one of the heat energy highly reflective surfaces of the at least one of the highly reflective insulation elements, and a second surface opposite the first surface support another of the heat energy highly reflective surfaces of another of the highly reflective insulation elements.

Any of the foregoing can include one or more of the following features. The heat energy highly reflective surfaces have an emittance of less than or equal to 0.05. The heat energy highly reflective surfaces have an emittance of less than or equal to 0.04. The heat energy highly reflective surfaces have an emittance of about 0.03. The heat energy highly reflective surfaces are provided by a layer of highly reflective foil. The heat energy highly reflective surfaces are provided by a layer of metal foil. The heat energy highly reflective surfaces are provided by a layer of aluminum foil.

Any of the foregoing can include one or more of the following features. the material insulation element has a resistance factor of greater than about R-3.6 per inch. The material insulation element has a resistance factor of at least R-3.6 per inch. The material insulation element has a resistance factor in the range of R-3.6 per inch to R-8.0 per inch. The material insulation element can include rigid foam board insulation.

The following Detailed Description references the accompanying drawings which form a part this application, and which show, by way of illustration, specific example implementations. Other implementations may be made without departing from the scope of the disclosure.

Figure 1:
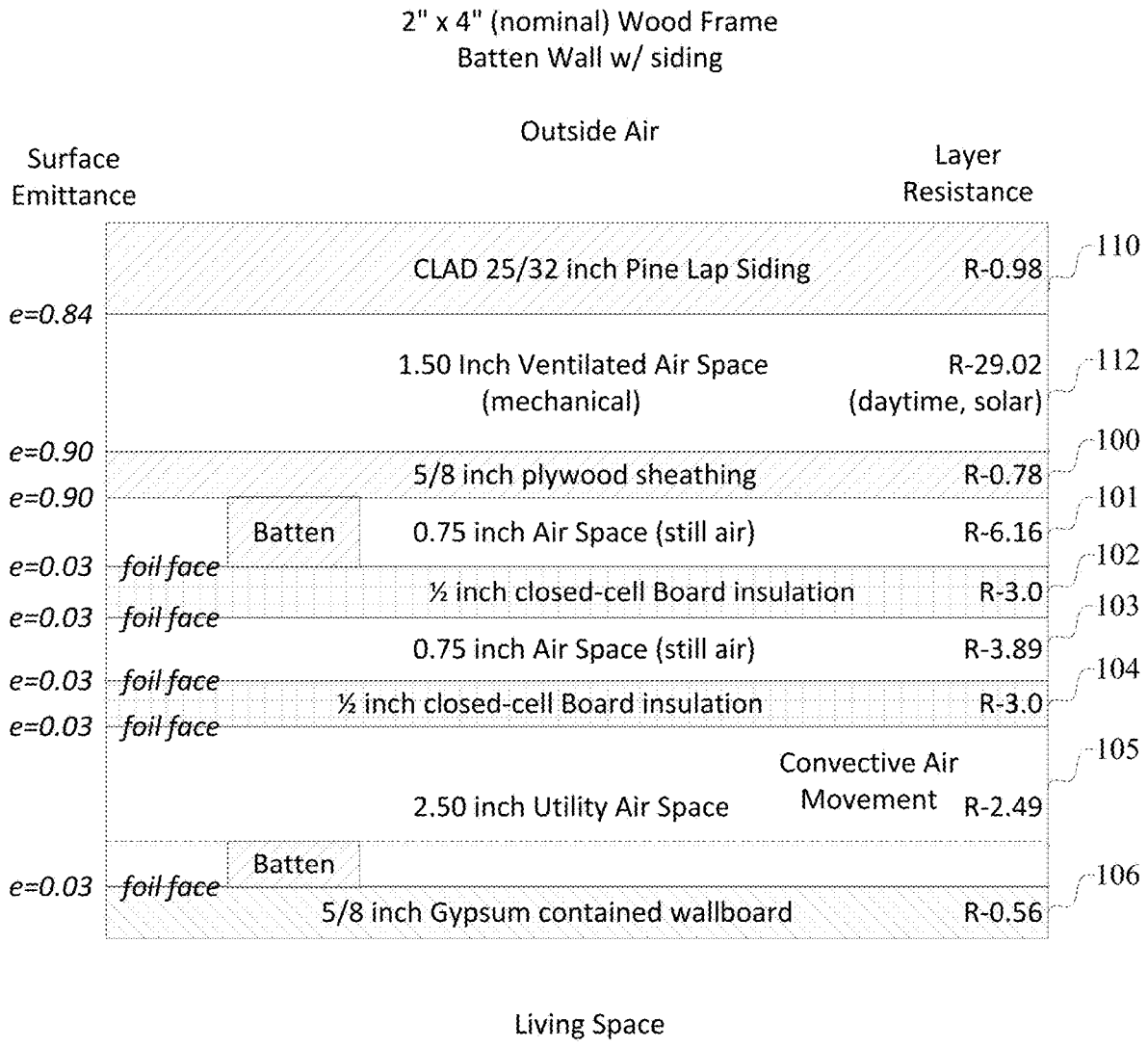
FIG. 1 is a schematic drawing of an example implementation of a wall structure.

The structures shown in the drawings are generally shown as cross-section, top-down views of the structures and are not intended to be to scale.

DETAILED DESCRIPTION

FIGS. 6A to 6H illustrate schematic diagrams of example implementations. Not shown in these schematics are studs or other framing of the wall or other building structure in which the illustrated structures can be placed. Similar constructions can be applied between a pair of studs or other framing for any other opaque building structure, such as ceiling, floor, roof, attic, crawlspace, or basement, or other opaque building structure that forms part of an enclosed living space.

Figure 6A:
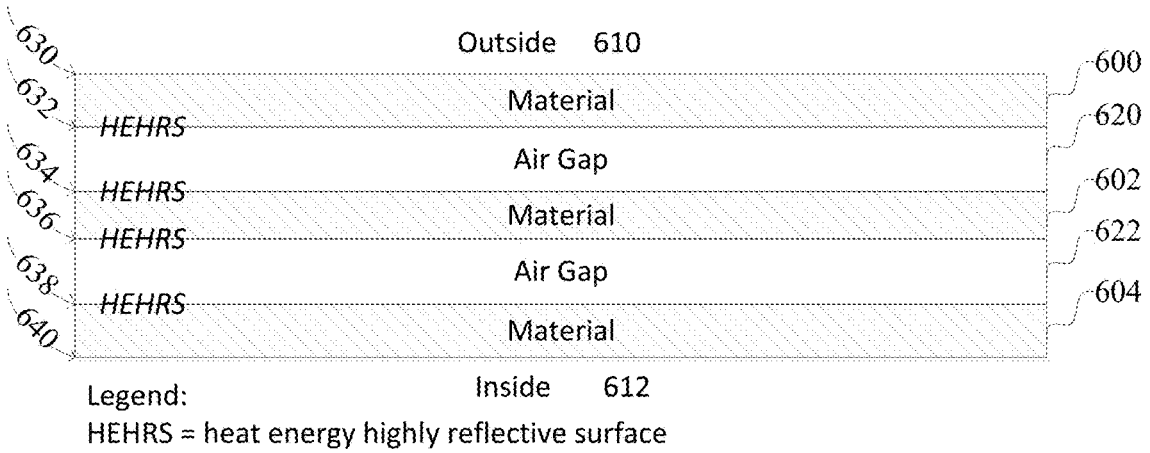
FIGS. 6A through 6H are schematic drawings of example structures.
Figure 6B:
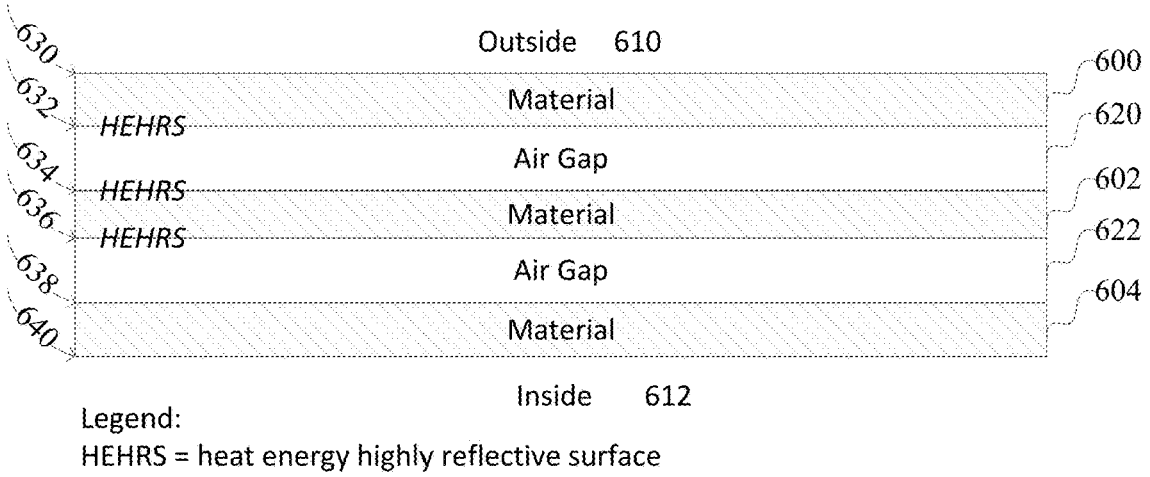
Figure 6C:
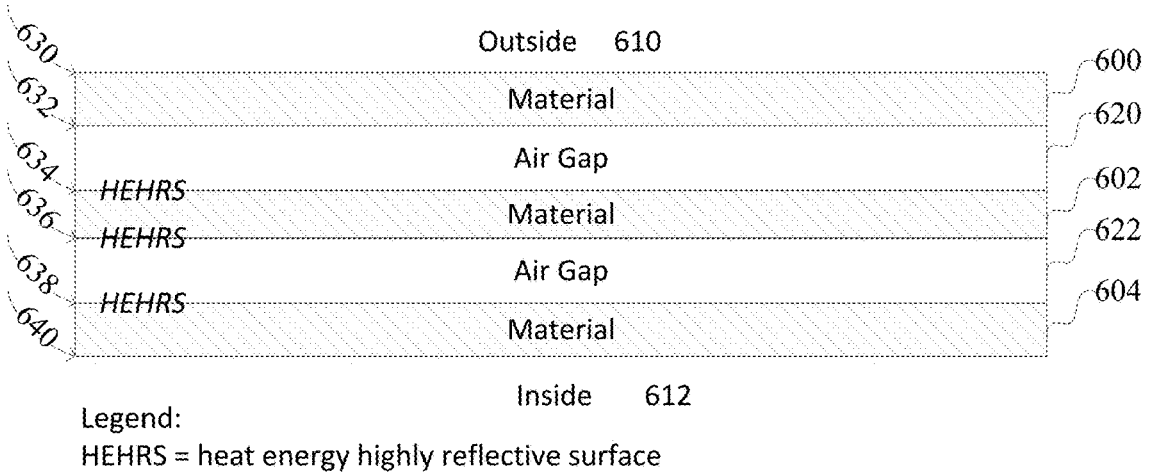

FIGS. 6A-6C illustrate a first material 600, a second material 602, and a third material 604. In some implementations, such materials can be a board such as 0.25 inch (nominally) thick plywood or fiberboard.

In some implementations, the first material 600 may form part of or may be an exterior wall, such as sheathing or panel board, such as 0.50 inch (nominally) thick plywood or fiberboard, or 0.25 inch (nominally) thick plywood or fiberboard or hardboard. In some implementations, the first material 600 may be separate from the exterior wall. In some implementations, the first material can be a combination of materials, such as a commercially available product, optionally applied to sheathing. For example, a polyurethane insulating panel, such as a PUREWALL panel from Covestro, may be used. For example, an insulation material called HYBRIS from Actis also can be used.

In some implementations, the second material can be a single material panel or sheet, a composite of multiple materials or panels of materials, or a device such as described below in connection with FIGS. 6D and 6E. In some implementations, the second material can be or can include any device that acts to restrict or even nearly eliminate continued conductive heat flow through the opaque building structure.

In some implementations, the third material 604 may form part of or may be an interior wall, such as a wallboard. In some implementations, the third material may be separate from the interior wall. The outside of a building is illustrated at 610; the inside of the building is illustrated at 612, for reference.

In FIGS. 6A-6C, between the first material 600 and the second material 602 is a first air gap 620 or first enclosed air space. Between the second material 602 and the third material 604 is a second air gap 622 or second enclosed air space.

In FIGS. 6A-6C, the first material 600 has an outer surface 630 and a first surface 632 opposite the outer surface. The second material 602 has a second surface 634 and a third surface 636 opposite the second surface. The third material 604 has an inner surface 640 and a fourth surface 638 opposite the inner surface. Thus, the first surface 632 and the second surface 634 form the first enclosed air space 620. The third surface 636 and the fourth surface 638 form the second enclosed air space 622.

On the first material 600, the first surface 632 can be a first heat energy highly reflective surface (HEHRS), as shown in FIGS. 6A and 6B. On the second material 602, the second surface 634 is a second heat energy highly reflective surface, and the third surface is a third heat energy highly reflective surface as shown in FIGS. 6A, 6B, and 6C. On the third material 604, the fourth surface 638 can be a fourth heat energy highly reflective surface, as shown in FIGS. 6A and 6C.

FIGS. 6D to 6G illustrate schematic diagrams of additional example implementations of wall constructions.

Figure 6D:
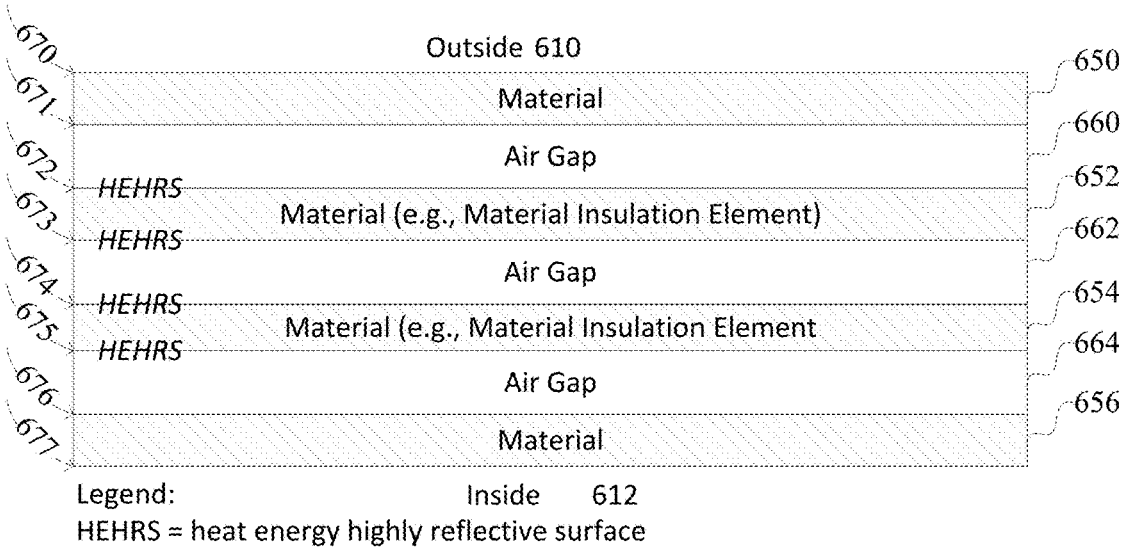
Figure 6E:
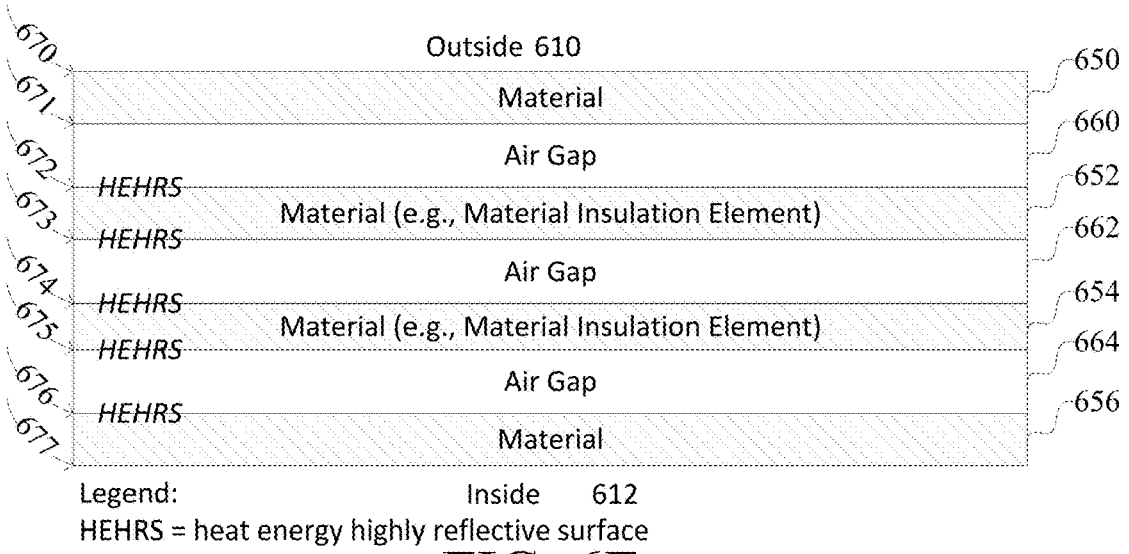

FIGS. 6D and 6E illustrate a first material 650, a second material 652, a third material 654, and a fourth material 656. In some implementations, such materials can be a board such as 0.25 inch (nominally) thick plywood or fiberboard. In some implementations, the first material 650 may form part of or may be an exterior wall, such as sheathing or panel board, such as 0.50 inch (nominally) thick plywood or fiberboard, or 0.25 inch (nominally) thick plywood or fiberboard or hardboard. In some implementations, the first material 650 may be separate from the exterior wall. The first material 650 can be any material described in connection with FIGS. 6A through 6C.

In some implementations, the fourth material 656 may form part of or may be an interior wall, such as a wallboard. In some implementations, the fourth material 656 may be separate from the interior wall. The outside of a building is illustrated at 610; the inside of the building is illustrated at 612, for reference.

In FIGS. 6D and 6E, between the first material 650 and the second material 652 is a first air gap 660 or first enclosed air space. Between the second material 652 and the third material 654 is a second air gap 662 or second enclosed air space. Between the third material 654 and the fourth material 656 is a third air gap 664 or third enclosed air space. In some implementations, this third air gap can be eliminated, leaving a structure similar to that shown in FIGS. 6A-6C.

In FIGS. 6D and 6E, the first material 650 has a first outer surface 670 and a first inner surface 671 opposite the first outer surface. The second material 652 has a first surface 672 and a second surface 673 opposite the first surface. The third material 654 has a third surface 674 and a fourth surface 675 opposite the third surface. The fourth material 656 has a second inner surface 676 and a second outer surface 677 opposite the second inner surface. Thus, the first inner surface 671 and the first surface 672 form enclosed air space 660. The second surface 673 and the third surface 674 form enclosed air space 662. The fourth surface 675 and the second inner surface 676 form enclosed air space 664.

In FIGS. 6D and 6E, on the first material 650, as this material can be any conventional outer wall construction, the first outer surface 670 and first inner surface 671 can be any kind of surface, such as the conventional surface of the conventional material. Similarly, on the fourth material 656, as this material can be any conventional inner wall construction, the second outer surface 677 and second inner surface 676 can be any kind of surface, such as the conventional surface of the conventional material, as shown in FIG. 6D. In FIG. 6E, the second inner surface 676 is shown as having a fifth heat energy highly reflective surface.

In FIGS. 6D and 6E, for the second material 652, both the first surface 672 and the second surface 673 are first and second, respectively, heat energy highly reflective surfaces. For an above grade wall, for the third material 654, both the third surface 674 and the fourth surface 675 are third and fourth, respectively, heat energy highly reflective surfaces. One or both of the second material 652 or third material 654 can be a material insulator.

As described in more detail below, the combination of the second material 652 and third material 654 enclosing an air space 662, with each material 652 and 654 having heat energy reflecting surfaces (672, 673, 674, 675), forms a device which can be inserted into the framing of a variety of different building structures to provide energy efficient management of temperature within a building. In some implementations, such a device can be used as the second material 602 in FIGS. 6A-6C.

Figure 6F:
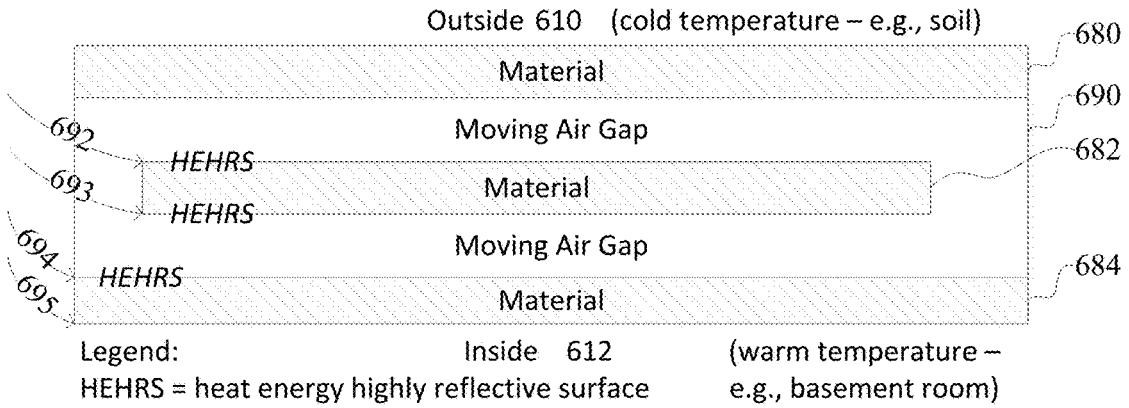

FIG. 6F illustrates an example implementation for a wall construction where heat flow direction is generally the same regardless of the season (winter or summer), such as a below-grade wall, such as in a basement or other subterranean construction. In FIG. 6F, there is a first material 680, a second material 682, and a third material 684. In some implementations, the first material 680 may form part of or may be an exterior wall, such as a concrete or other material foundation. The first material 680 is nearer to a colder temperature, such as the soil. In some implementations, such materials can be a board such as 0.25 inch (nominally) thick plywood or fiberboard. In some implementations, the third material 684 may form part of or may be an interior wall, such as a wallboard. The third material is nearer to a warmer temperature, such as a basement room.

In FIG. 6F, around the second material 682 is an air space 690 within which air can naturally circulate. The second material 682 has a first surface 692 and a second surface 693 opposite the first surface. The third material 684 has a third surface 694 and a fourth surface 695 opposite the third surface. Thus, an inner surface of the first material 680 and the third surface 694 of the third material 684 form the air space 690.

In FIG. 6F, on the first material 680, as this material can be any conventional outer wall construction, its inner surface can be the conventional surface of the conventional material. For the second material 682, both the first surface 692 and the second surface 693 are first and second, respectively, heat energy highly reflective surfaces. Similarly, on the third material 684, as this material can be any conventional inner wall construction, the fourth surface 695 can be any kind of surface, such as the conventional surface of the conventional material. The third surface 694 is shown as having a third heat energy highly reflective surface.

Figure 6G:
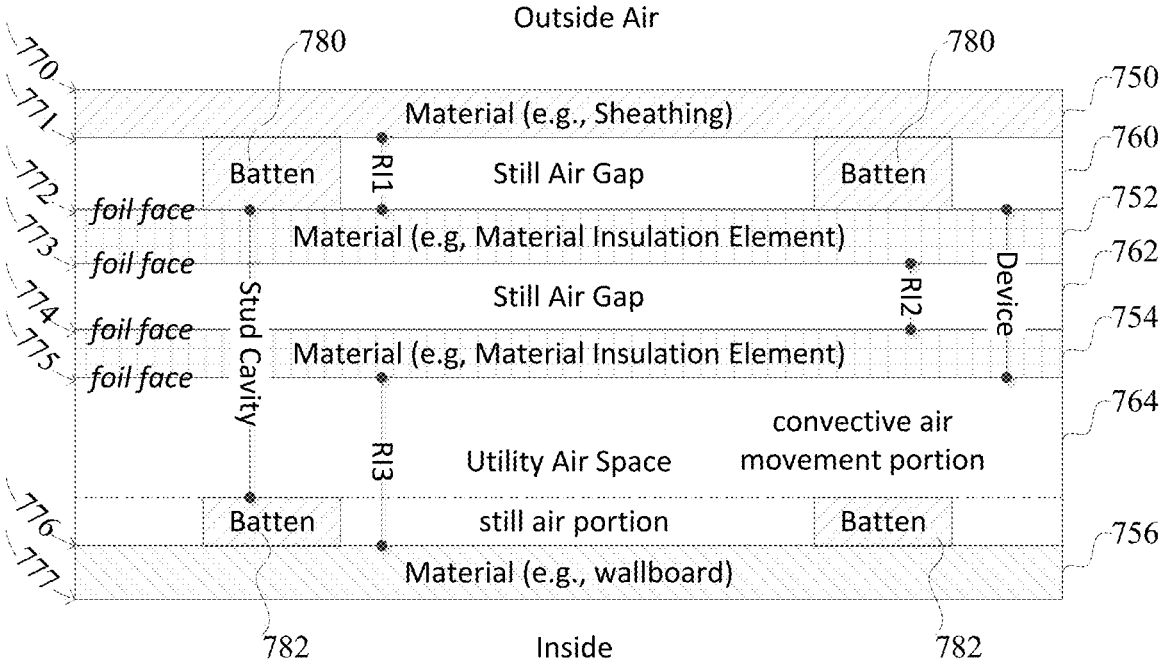

In FIG. 6G, a detailed schematic of an example implementation is shown using a device in a typical 2"×4" (nominal) stud framing with battens of a building. Similar to FIGS. 6D and 6E, in FIG. 6G, a first material 750 has a first outer surface 770 and a first inner surface 771 opposite the first outer surface. A second material 752 has a first surface 772 and a second surface 773 opposite the first surface. A third material 754 has a third surface 774 and a fourth surface 775 opposite the third surface. A fourth material 756 has a second inner surface 776 and a second outer surface 777 opposite the second inner surface.

As in FIGS. 6D and 6E, in the example device shown in FIG. 6G, for the second material 752, both the first surface 772 and the second surface 773 are first and second, respectively, heat energy highly reflective surfaces. For third material 754, both the third surface 774 and the fourth surface 775 are third and fourth, respectively, heat energy highly reflective surfaces.

As described in more detail below, the combination of the second material 752 and third material 754 enclosing an air space 762, with each material 752 and 754 having heat energy highly reflective surfaces (772, 773, 774, 775), forms a device that can be inserted into a wall or other opaque building structure to provide energy efficient climate control. In some uses, this device can be inserted into framing of a wall within a building as shown in FIG. 6G. In this example implementation, the second material 752 and the third material 754 are each illustrated as a material insulator, e.g., an insulating board, such as 0.50 inch (nominally) insulating board. The air gap 762 is about 0.75 inches thick. Thus, the device is about 1.75 inches thick.

In FIG. 6G, the first material 750 can be any conventional outer wall construction such as sheathing or siding. Thus, the first outer surface 770 and first inner surface 771 can be any kind of conventional surface of the conventional outer wall construction. Similarly, the fourth material 756 can be any conventional inner wall construction. Thus, the second outer surface 777 and second inner surface 776 can be any kind of conventional surface of the conventional inner wall construction.

In FIG. 6G, a first plurality of battens 780 are spaced along the inner surface of the outer wall material 750. Similarly, a second plurality of battens 782 are spaced on the inner surface of the inner wall material 756. Some (if not all) of the battens can connect to studs (not shown) that form the walls. With battens 782 that are nominally 0.75 inches thick, and with a typical 2"×4" (nominal) stud framing, which is typically about 3.5 inches thick, the device can be inserted within the stud framing and still provide a utility air space (air gap 764) of a typical size of 2.5 inches.

Also, in FIG. 6G, using the battens 780, the first inner surface 771 and the first surface 772 form an enclosed air space 760. The second surface 773 and the third surface 774 form enclosed air space 762. The fourth surface 775 and the second inner surface 776 form enclosed air space 764. The use of battens also can, without being bound by theory, create a non-convective zone adjacent a surface supported by the battens, and a convective zone away from that surface.

Figure 6H:
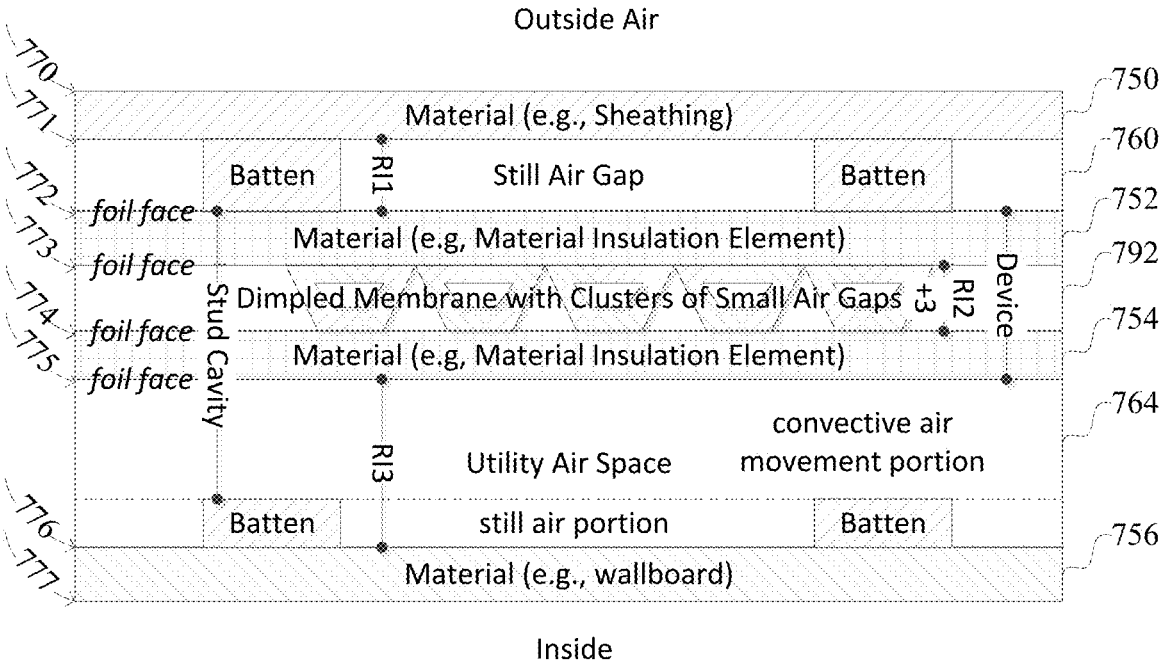

In FIG. 6H, a detailed schematic of an example implementation is shown using another example implementation of a device in a typical 2"×4" (nominal) stud framing with battens of a building. This implementation is otherwise similar to that shown in FIG. 6G, but air gap 792 within the device can be filled with a material, such a dimpled membrane or other material with a cluster of small air gaps. An example of such a dimpled membrane is a high-density polyethylene (HDPE) dimple sheet made by Superseal Construction Products, Ltd. In some implementations, the second material 752 and third material 754 can be made of materials.

Without being bound by theory, an explanation of the terms and presumed mode of operation of such a device within a building construction will now be described.

The term "heat energy highly reflective" layer or surface (HEHRS) refers to a layer on a material or a surface of a material which provides that material with a surface which is highly reflective of heat energy, i.e., the surface emittance of heat energy of less than 0.05. In some implementations the surface emittance is preferably less than or about 0.04. In some implementations the surface emittance is preferably less than or about 0.03. In some implementations, the surface emittance is preferably in a range of about 0.05 to 0.03 (or less), 0.04 to 0.03 (or less). In some implementations, a thin metal foil sheet can be used as a layer applied to a material to provide a heat energy highly reflective surface. An aluminum foil sheet with a surface emittance of 0.03 can be used. Such a surface reflects or blocks most heat energy exchange from another material across an adjacent air space. Other heat energy highly reflective materials can be used, such as certain metals, alloys, compounds, or other materials, and the invention is not limited to use of aluminum foil.

A surface is called a non-reflecting surface when the surface emittance of heat energy is greater than about 0.25. A surface is called reflective when the surface emittance of heat energy is less than about 0.10. A surface that is neither non-reflective nor reflective may be called "fairly reflective" or "partially reflective". Many typical building materials, such wood, plastic, or concrete, have a natural surface which typically is non-reflective of heat energy, with a surface emittance of about 0.90. Similarly, when the surfaces of such materials are painted with conventional paint, the surface typically remains non-reflective of heat energy. Because the surface of the material is non-reflective, most heat energy exchanged across any adjacent material or air space is retained in the receiving material mass.

The term "reflective insulation element" refers to the combination of a confined air space and bounding surfaces of two parallel opaque materials enclosing the air space, when one or both of the bounding surfaces is a heat energy reflecting surface. A "highly reflective insulation element" is a reflective insulation element in which at least one of the enclosing surfaces of the confined air space is a heat energy highly reflective surface. The effective emittance of the reflective insulation element depends on many factors, such as the size and constitution of the air gap, surface emittances of the enclosing surfaces, textures of the surfaces, and other factors, and generally is determined experimentally for any combination. Notably, the effective emittance is substantially lower when at least one heat energy highly reflective surfaces is used and is even lower when both surfaces are heat energy highly reflective surfaces.

Within a confined air space, the material with the heat energy highly reflective surface herein is called a "radiant shield". If a wall assembly space is not confined, and instead is open, then the term "radiant barrier" is used herein, because an equivalent R-value cannot be determined by experimental testing of heat transfer conductivity of an unconfined space.

The term "material insulation element" or "material insulator" means any form of solid material, such as a panel, board, spray foam (when solidified), rigid foam insulation, or other element, where the material is opaque and primarily insulating with respect to heat energy. The material insulation element may have voids. The material insulation element is preferably homogeneous in the direction of heat transfer. Conventionally such materials have a so-called "R-factor" or "R-rating" indicating a measure of its resistance to heat transfer. For these purposes, an R-factor greater than R-3.6 per inch is typically insulating and many products are in the range of R-3 to R-8 per inch.

The term "air space" or "air gap" can be either still air or moving air. With still air, there is little or no convection, and any heat transfer occurs primarily by conduction. With moving air, heat transfer can occur by both convection and conduction.

The term "device" means any combination of materials that, when inserted into a wall construction, forms a sequence of two or more parallel highly reflective insulation elements in the direction of heat flow in combination with a material insulator providing one or more of the heat energy highly reflective surfaces. In some implementations, the device can be any two-sided material element which forms a reflective insulation element on either side of it in a cavity. In some implementations, the device can include two material insulation elements with an air space in between them. In some implementations, the surfaces enclosing the air space are both heat energy highly reflective surfaces.

A highly reflective insulation element is formed by an air gap and two enclosing parallel surfaces, of which one or both of the surfaces is a heat energy highly reflective surface. Heat energy transfers through the air gap from the surface with the greater heat energy to the other surface with lower heat energy. When the surface with the lower heat energy is a heat energy highly reflective surface, most of that heat energy is reflected back to the other surface. While some heat energy passes through the heat energy highly reflective surface, in the device, that heat energy highly reflective surface is on a material insulator. The material insulator retards transfer of heat energy to its opposite surface. The opposite surface can be one surface of another highly reflective insulation element. A sequence of two or more highly reflective insulation elements in the direction of heat transfer incorporating two or more material insulating elements provides a hybrid material insulating/highly reflective insulating device.

The term "rigid foam insulation" is a kind of material insulation element and refers to a variety of low-density, homogeneous, opaque foam materials. The "Resistance" property or "R-factor" of such materials typically is in the range of R-3.0 per inch to R-8.0 per inch. By way of example only, and not intended to be limiting, such materials include: expanded polystyrene (EPS), typically with R-3.6 per inch to R-4.0 per inch; extruded polystyrene (XPS) typically with R-4.5 to R-5 per inch, and polyisocyanurate (polyiso) typically with R-7.0 per inch to R-8.0 per inch. When a heat energy highly reflective layer is applied to a surface of a panel of rigid foam insulation panel, the layer provides the panel with a heat energy highly reflective surface. The surface of the rigid foam insulation panel forms a radiant shield to any adjacent confined air space that surface faces in a highly reflective insulation element.

Thus, without being bound by theory, having two or more enclosed air gaps in combination with heat energy highly reflective surfaces on materials adjacent those air gaps, examples of which are shown in FIGS. 6A through 6G, provides efficient heating and cooling of living space enclosed by such construction. When conductive heat flow through the walls is in different directions in winter and summer, for example in above-grade wall assemblies in temperate climates such as shown in FIG. 6D, 6E, 6G, or 6H, three enclosed air gaps with four heat energy highly reflective surfaces across air gaps provides efficient radiant heating and cooling of the living space enclosed by such construction. When conductive heat flow through the walls is in the same direction in both winter and summer, such as in a basement wall assembly as shown in FIG. 6F, two enclosed air gaps with three heat energy highly reflective surfaces across air gaps provides efficient radiant heating and cooling of the living space enclosed by such construction.

In the examples above, without being bound by theory, FIG. 6D is a two-season system for a moderate climate, which has a four stages of radiant shields. FIG. 6E has 5-stages of radiant shields which, with radiant shields with 0.03 emittance, block near 100% of the heat energy transmission in the stud space, when heat flow path is inbound from the exterior to the interior. The inner wallboard material surface thus remains closer to the room air temperature set by a cooling system, and thus would be preferable for very hot summer climates. FIG. 6F has three stages of radiant shields and is suitable for moderate winters and basements.

Further example implementations are shown in FIGS. 1 through 5, which can be made using any of the structures shown in FIGS. 6D through 6G. Similar implementations using the structures of FIGS. 6A through 6C also can be used. In these examples, the mechanically ventilated air spaces can be eliminated in some constructions. In some of these examples, without being bound by theory, predicted R-values of the materials and spaces, and corresponding emittance ("e"-values herein) of the surfaces are provided in the Figures. In these Figures, the annotation of an HEHRS as a "foil face", and in the description any reference to a foil face, or foil-backed material or surface, is merely illustrative of one example implementation and is not intended to be limited.

In FIG. 1, the first material 100 can be a 0.625 inch (nominal) thick sheathing, such as plywood. A 0.75-inch-thick air gap 101 is formed between the sheathing and a material insulation element 102, e.g., a closed-cell foam rigid board insulation. In this example, the material insulation element has a 0.5-inch nominal thickness. The material insulation element is the second material which has a foil face on each surface, one facing air space 101 and another facing air space 103. A 0.75-inch-thick air gap 103 is formed between the material insulation element 102 and anther material insulation element 104, e.g., a closed-cell foam rigid board insulation. In this example, the material insulation element 104 also has a 0.5-inch nominal thickness. The material insulation element 104 is a third material which has a foil face on each surface, one facing air space 103 and another facing air space 105. A fourth material 106 is a wallboard which also can be foil faced. In this example, the wallboard has a nominal 0.625-inch thickness and forms the air space 105, which can be used as a utility air space between the wallboard and the insulation 104. This construction can be used with conventional 2.0 inch by 4.0-inch (nominal) wood wall stud framing which provides about a 3.5-inch-thick stud cavity, where the sheathing and the wallboard (optionally with a spacer or batten) are attached to the interior and exterior sides of the studs. Siding 110 can be applied to the sheathing, optionally leaving a ventilated air space 112, optionally mechanically ventilated, with an example spacing of 1.5 inches. Preferably, the foil faced surfaces are all heat energy highly reflective surfaces, such as by having a thin layer of aluminum foil.

Figure 2:
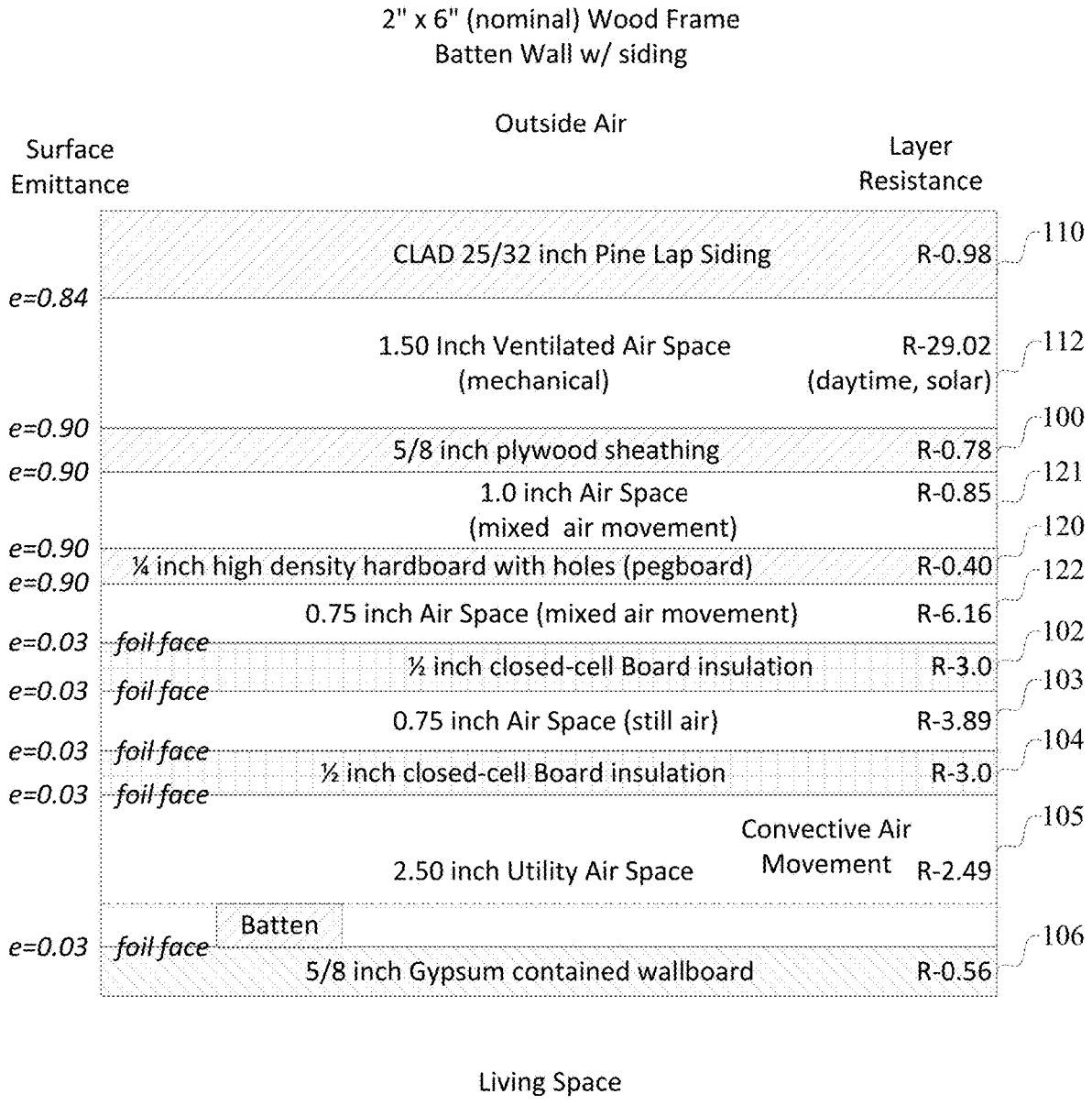
FIG. 2 is a schematic drawing of another example implementation of a wall structure.

FIG. 2 is similar to FIG. 1, but with an additional air space. This construction can be used with conventional 2.0 inch by 6.0-inch (nominal) wood wall stud framing which provides about a 5.5-inch-thick stud cavity, where the sheathing and the wallboard (optionally with a spacer or batten) are attached to the interior and exterior sides of the studs. In this example, material insulation 102 and 104 can be 0.5 inch (nominal) thick closed cell board insulation, with foil faces on both surfaces. In this example, a perforated hardboard panel 120, such as a commercially available 0.25 inch (nominal) thick pegboard, is provided within a larger air space to divide the air space into a first air space 121 and a second air space 122, allowing mixed air movement between air spaces 121 and 122, and in addition the creation of a temporary thermal mass heat sink during hot summer climate conditions.

Figure 3:
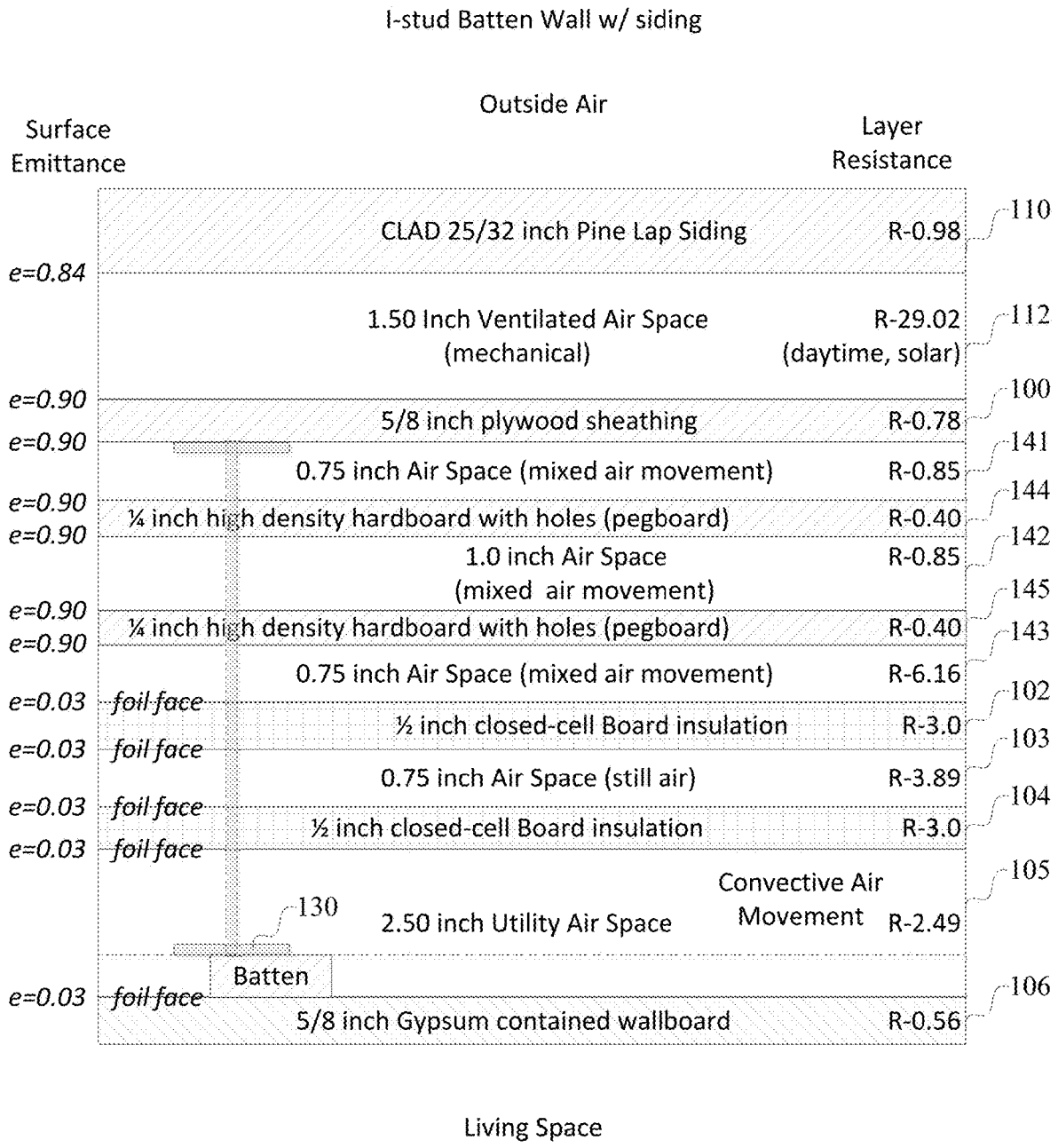
FIG. 3 is a schematic drawing of another example implementation of a wall structure.

FIG. 3 is similar to FIGS. 1 and 2 but has a different set of air spaces. This construction can be used with a 2.0 inch by 6.0-inch (nominal) wood wall stud framing with a 1.0 inch thick (nominal) by 6.0-inch-wide flange 130 attached to the interior and exterior surfaces of the studs which provides about a 7.0-inch-thick stud cavity. The sheathing and the wallboard (optionally with a spacer or batten) are attached to the interior and exterior sides of the flanges. In this example the material insulation 102 and 104 also has a 0.5-inch nominal thickness. A larger air space is separated into air spaces 141, 142, and 143 by two perforated boards 144, 145 between the foil-backed material insulation 102 and the sheathing 100. In this example, the perforated boards can be 0.25-inch nominal thickness high density hardboard.

In FIGS. 2 and 3, the mixed air movement around a pegboard in an air space balances the temperature and pressure between the different portions of the air space on opposing sides of the pegboard. This air space and the pegboard in it can act as a heat sink, which can be particularly useful in environments where heat gain due to solar energy on the exterior of the building structure is high.

Figure 4A:
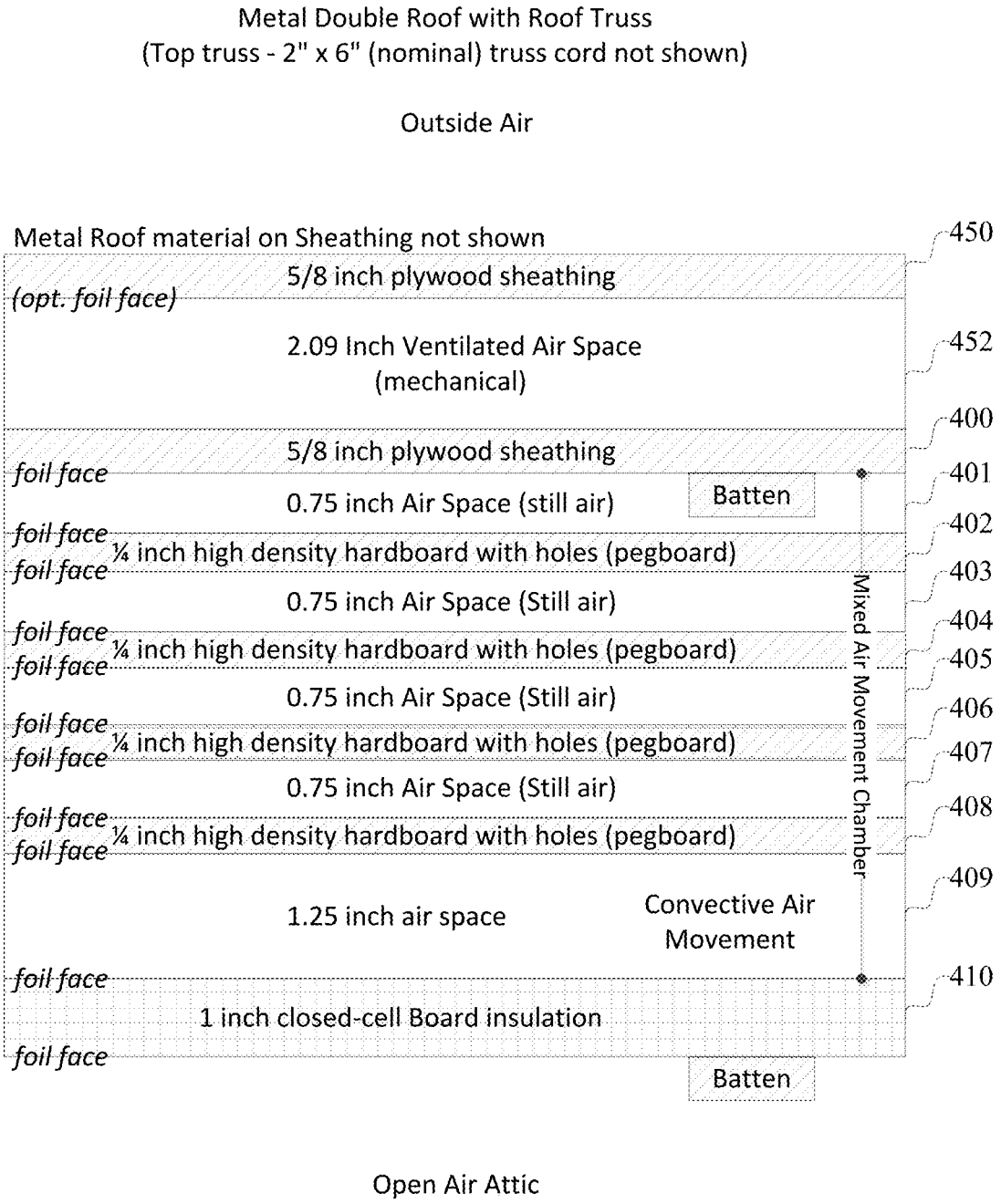
FIG. 4A is a schematic drawing of another example implementation of a building structure including a roof truss.

FIG. 4A includes an example construction for supporting a roof, in this example a metal double roof. In this example, a 2.0-inch by 6.0-inch (nominal) wood top cord (not shown) is attached between the interior wall and the exterior sheathing. In this example, between the interior wall and the exterior sheathing are five foil-enclosed air spaces. A sheathing 400 can be foil-faced on the interior surface. Four of the air spaces (401, 403, 405, 407) are approximately 0.75 inches, separated by 0.25 (nominal) thickness materials (402, 404, 406, 408), e.g., a high-density hardboard, each of which can be foil-backed on one or both surfaces. The interior-most material is a material insulation element 410, e.g., closed-cell foam rigid board, having both sides with foil facings. Convective air movement can be provided in the air space 409 between material insulation 410 and hardboard 408 A ventilated air space 452 can be provided between sheathing 450 supporting the upper slope roof and the sheathing 400 attached to the house truss structure. This sheathing 450 also can have a foil backing.

Figure 4B:
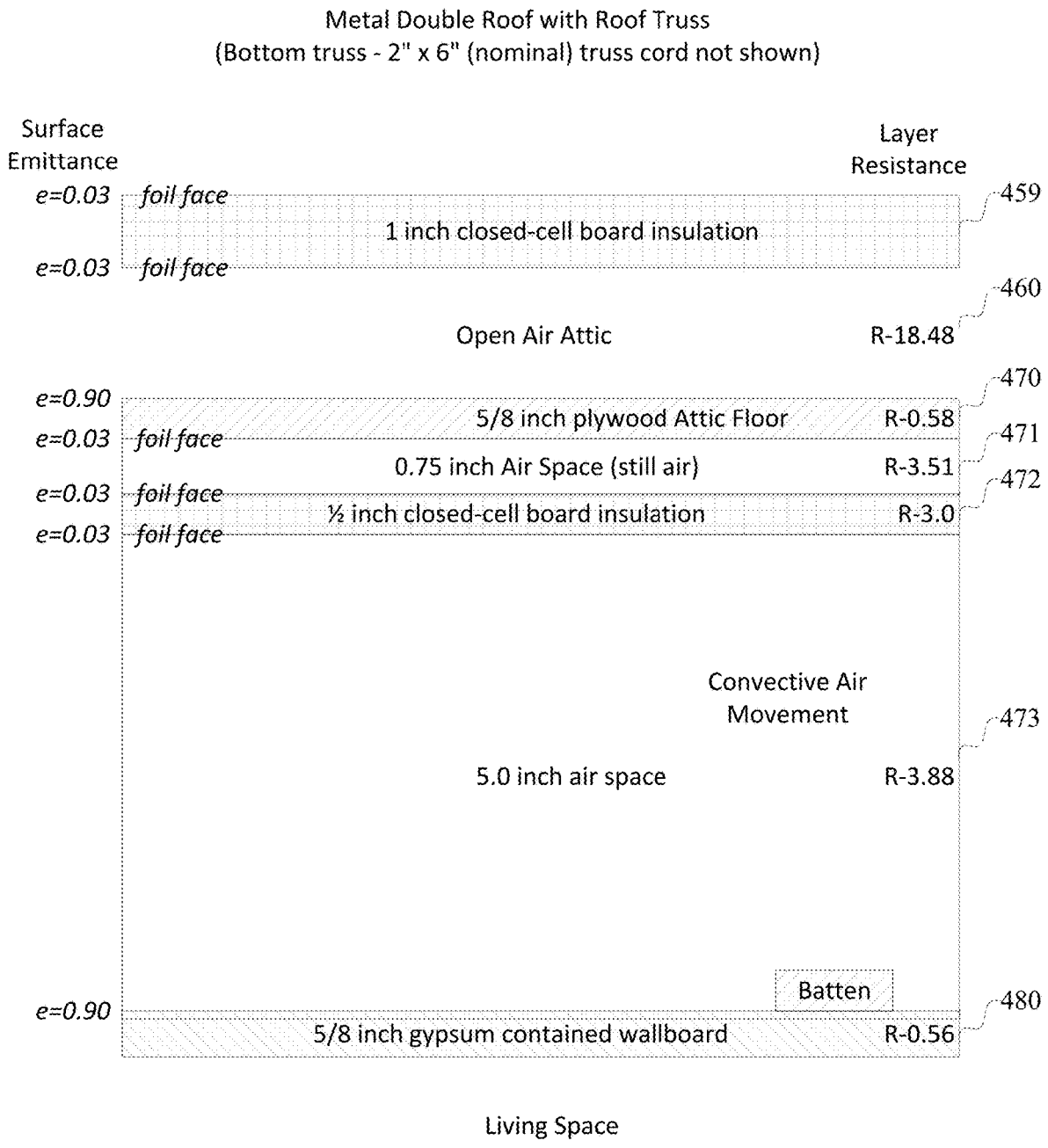
FIG. 4B is a schematic drawing of another example implementation of a building structure including an attic.

In FIG. 4B, the attic space 460 beneath the roof structure shown in FIG. 4A, as exemplified at 459, is a variable wide air space above an attic floor, which includes a subfloor. Beneath the subfloor, and above the ceiling in the living space below, also can include foil-backed materials forming foil-enclosed air spaces. In this example, the floor joists are 2.0 inch by 6.0-inch (nominal) wood planks to which the attic subfloor 470 is attached above, and to which wallboard 480 or other ceiling material is connected below, optionally with a spacer or batten. The ceiling material has a foil-backed surface. Within the space between the subfloor and the ceiling is formed at least two air spaces 471 and 473. A first air space 473 is foil-enclosed between a material insulation element 472 that is foil backed and the ceiling material. The second air space 471 is between the subfloor 470 and the other foil-backed surface of the material insulation element 472.

Figure 5:
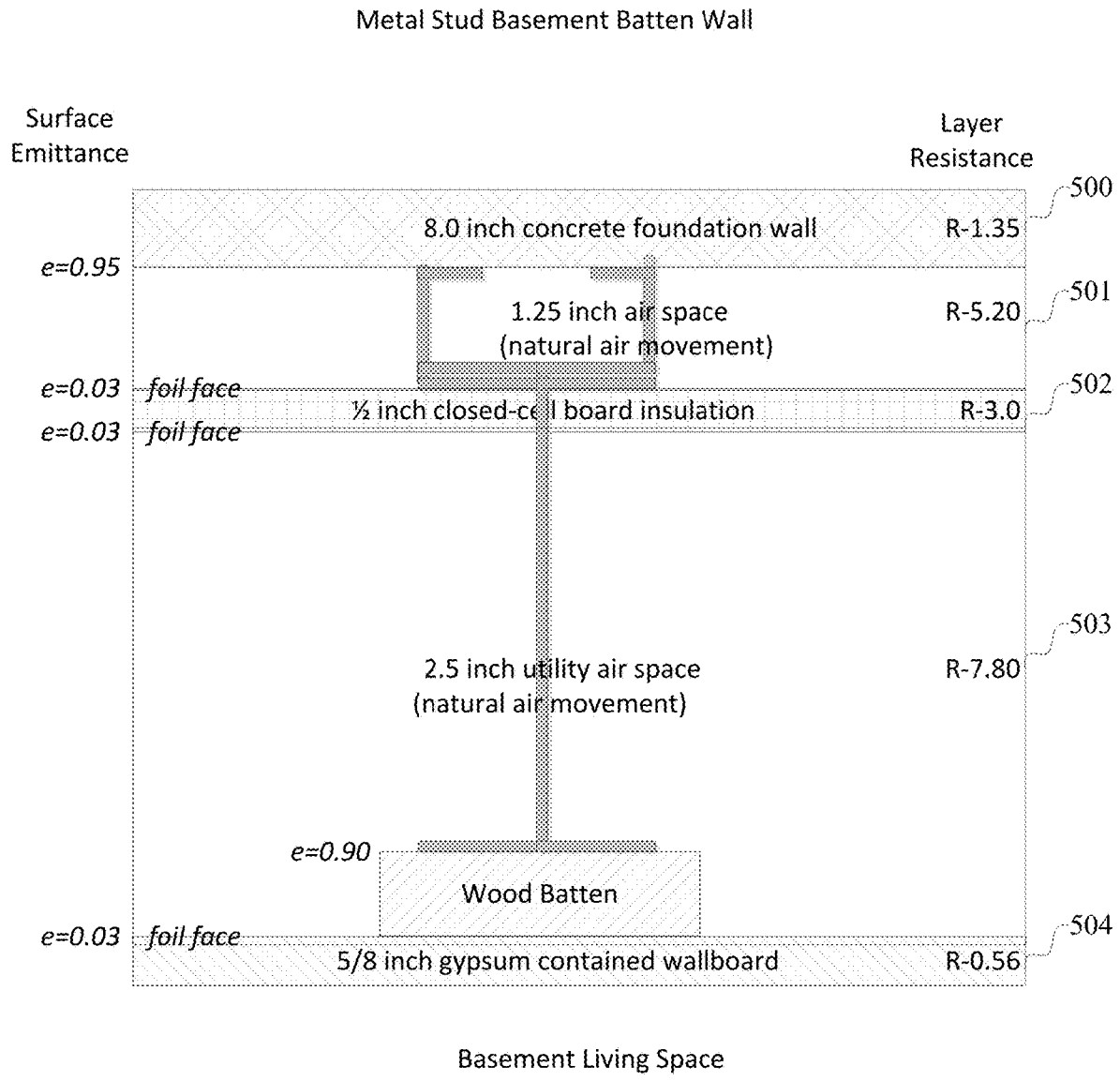
FIG. 5 is a schematic drawing of another example implementation of a building structure including a basement wall.

FIG. 5 is an example construction that can be used with a concrete foundation wall and metal studs to support an interior wall structure finishing the concrete wall. In this example, material insulation element 502, e.g., a closed-cell board, which has two foil-backed surfaces forms an air space 501 with the concrete foundation 500 on one side, and a foil-enclosed air space 503 with a foil-backed wallboard 504 on the other side. The second air space is formed around the metal studs and is formed with bottom and top open slots to allow natural air movement flow.

In these various examples, without being bound by theory, energy efficiency is provided because two or more air spaces are enclosed by surfaces of which at least one is a provided by a radiant shield or is a heat energy highly reflective surface, which forms a highly reflective insulation element. The surfaces with the heat energy highly reflective material reflect or block transfer of most of the heat energy that hits them and allows a minimum amount of heat energy to pass through them into the materials behind those surfaces (such as a wood board or insulator board). Thus, heat energy between the two surfaces in an air space tends to remain captured in that air space. The temperature of the receiving surface elevates, while the temperature of the sending surface reduces, but at different rates, until an equilibrium is reached. When the air space is still, at approximately 0.75 inches maximum thickness, this heat energy exchange is mostly conductive and not convective. Energy efficiency is maximized when at least one of the radiant shields or heat energy highly reflective surfaces reflects about 97% or more of the heat energy that hits it.

In some implementations, the first enclosed air space can have a thickness of about 0.75 inches. The second enclosed air space can have a thickness of about 0.75 inches. A third enclosed air space can have a thickness of about 1.50 inches to 2.50 inches and act as a utility air space. The first, second, and third materials can be of similar construction, such as 0.25-inch-thick wood boards.

In some implementations, when a sheathing is attached to an outer surface of the studs, the sheathing and the outer surface of the first material form an outer air space. When a wallboard is attached to an inner surface of the studs, the wallboard and the inner surface of the third material form a utility air space. The outer air space can have a thickness in the range of about 1.0 inches to 1.5 inches. The utility air space has a thickness in the range of about 3.0 inches to about 4.0 inches.

In some implementations, a device can include two material insulation elements with an enclosed air gap between them of about 0.75 inches, and with each material insulation element having both surfaces with a heat energy highly reflective surface, preferably and aluminum foil with an emissivity of about 0.03. The material insulation elements can be made of rigid foam board insulation and can be about 0.5 inches thick, making the device about 1.75 inches thick. Without being bound by theory, such a device produces four 97% heat block events in series through the heat energy highly reflective surfaces, and the material insulation elements provide a thermal mass that stores heat energy between highly reflective insulation elements.

Generally, the material insulation element has a thickness between 0.25 inches and 1.0 inches, depending on the material. The material can be, for example, plywood, hardboard, closed-cell board, open-cell board, rigid foam insulation, or yes other materials. Example commercially available materials include but are not limited to Polyiso board, closed-cell rigid foam board, Plascore polypropylene honeycomb board (closed-cell), Plascore polypropylene honeycomb board (open-cell). Any such materials can be manufactured as foil-backed, i.e., to have a heat energy highly reflective surface, or a layer can be applied to a surface of the material to provide the heat energy highly reflective surface.

It should be understood that the subject matter defined in the appended claims is not necessarily limited to the specific implementations described above. The specific implementations described above are disclosed as examples only.

What is claimed is:

1. An apparatus in an opaque building structure, comprising:

an exterior sheathing having an inner surface; and a tandem series of highly reflective insulation elements, comprising:

a first highly reflective insulation element comprising:

a first pair of parallel surfaces forming in part a first air space of still air, the first pair of parallel surfaces including the inner surface of the exterior sheathing and a first heat energy highly reflective surface; and a first material insulation element having a first face supporting the first heat energy highly reflective surface; and a second highly reflective insulation element comprising:

a second pair of parallel surfaces forming in part a second air space of still air, the second pair of parallel surfaces including a second heat energy highly reflective surface and a third heat energy highly reflective surface; and a second material insulation element having a first face supporting the third heat energy highly reflective surface; and wherein the first material insulation element has a second face supporting the second heat energy highly reflective surface.

2. The apparatus of claim 1, wherein the first material insulation element comprises rigid foam board insulation.

3. The apparatus of claim 1, wherein each of the first, second, and third heat energy highly reflective surfaces comprises a respective layer of aluminum foil.

4. The apparatus of claim 1, wherein each of the first, second, and third heat energy highly reflective surfaces has an emittance of less than or equal to 0.05.

5. The apparatus of claim 1, wherein each of the first, second, and third heat energy highly reflective surfaces has an emittance of less than or equal to 0.04.

6. The apparatus of claim 1, wherein each of the first, second, and third heat energy highly reflective surfaces has an emittance of less than or equal to 0.03.

7. The apparatus of claim 1, wherein the first material insulation element has a resistance factor of greater than about R-3.6 per inch.

8. The apparatus of claim 1, wherein the first material insulation element has a resistance factor of at least R-3.6 per inch.

9. The apparatus of claim 1, wherein the first material insulation element has a resistance factor in the range of R-3.0 per inch to R-8.0 per inch.

10. The apparatus of claim 1, wherein the second material insulation element has a second face opposite the first face, and wherein the second face supports a fourth heat energy highly reflective surface.

11. The apparatus of claim 10, wherein:

the first material insulation element comprises an insulation element having a resistance factor in the range of R-3.0 per inch to R-8.0 per inch;

the first heat energy highly reflective surface has an emittance of less than or equal to 0.05;

the second heat energy highly reflective surface has an emittance of less than or equal to 0.05;

the second material insulation element comprises an insulation element having a resistance factor in the range of R-3.0 per inch to R-8.0 per inch;

the third heat energy highly reflective surface has an emittance of less than or equal to 0.05;

the fourth heat energy highly reflective surface comprises has an emittance of less than or equal to 0.05;

wherein a width of the first air space between the first pair of parallel surfaces is about 0.75 inches; and wherein a width of the second air space between the second pair of parallel surface is about 0.75 inches.

12. An opaque building structure, comprising:

framing; and an exterior sheathing attached to the framing, the exterior sheathing having an exterior inner surface;

an interior wallboard attached to the framing, the interior wallboard having an interior inner surface;

between the space formed by the framing, the exterior inner surface, and the interior inner surface:

a tandem series of highly reflective insulation elements attached to the framing, comprising:

a first highly reflective insulation element comprising:

a first pair of parallel surfaces forming in part a first air space of still air, the first pair of parallel surfaces including the exterior inner surface and a first heat energy highly reflective surface and parallel with the exterior inner surface and the interior inner surface, and a first material insulation element having a first face supporting the first heat energy highly reflective surface; and a second highly reflective insulation element comprising:

a second pair of parallel surfaces forming in part a second air space of still air, the second pair of parallel surfaces including a second heat energy highly reflective surface and a third heat energy highly reflective surface, and parallel with the exterior inner surface and the interior inner surface; and a second material insulation element having a first face supporting the third heat energy highly reflective surface; and wherein the first material insulation element has a second face supporting the second heat energy highly reflective surface.

13. The opaque building structure of claim 12, wherein the second material insulation element has a second face opposite the first face, and wherein the second face supports a fourth heat energy highly reflective surface and forms an airspace with the interior inner surface of the interior wallboard.

14. The opaque building structure of claim 13, wherein:

the first material insulation element comprises rigid foam board insulation having a resistance factor in the range of R-3.0 per inch to R-8.0 per inch;

the first heat energy highly reflective surface comprises aluminum foil;

the second heat energy highly reflective surface comprises aluminum foil;

the second material insulation element comprises rigid foam board insulation having a resistance factor in the range of R-3.0 per inch to R-8.0 per inch;

the third heat energy highly reflective surface comprises aluminum foil;

the fourth heat energy highly reflective surface comprises aluminum foil;

wherein a width of the first air space between the first pair of parallel surfaces is about 0.75 inches; and wherein a width of the second air space between the second pair of parallel surface is about 0.75 inches.

* * * * *